US011260523B2

(12) United States Patent
Nguyen

(10) Patent No.: US 11,260,523 B2
(45) Date of Patent: Mar. 1, 2022

(54) HEIGHT ADJUSTABLE WORKSTAND SUPPORT

(71) Applicant: Nhon Hoa Nguyen, Bankstown (AU)

(72) Inventor: Nhon Hoa Nguyen, Bankstown (AU)

( * ) Notice: Subject to any disclaimer, the term of this patent is extended or adjusted under 35 U.S.C. 154(b) by 0 days.

(21) Appl. No.: 17/226,101

(22) Filed: Apr. 9, 2021

(65) Prior Publication Data

US 2021/0316439 A1 Oct. 14, 2021

Related U.S. Application Data

(60) Provisional application No. 63/007,369, filed on Apr. 9, 2020.

(51) Int. Cl.
*B25H 1/02* (2006.01)

(52) U.S. Cl.
CPC ..... *B25H 1/02* (2013.01)

(58) Field of Classification Search
CPC ... B25H 1/06; B25H 1/02; B25H 1/00; B25H 1/04; B25H 1/14; B25H 1/16; B25B 11/00; B23Q 3/00; B23Q 3/06; F16M 11/26; F16M 11/24; A47B 3/00; A47B 3/002; A47B 3/004; A47B 3/02
USPC ..... 269/16, 136–139; 182/181.1
See application file for complete search history.

(56) References Cited

U.S. PATENT DOCUMENTS 2,946,214 A * 7/1960 Gotay ..... E05C 9/12 70/118
3,792,885 A * 2/1974 Giardina ..... E05B 13/005 292/39
4,836,332 A * 6/1989 Henson ..... B25H 1/06 182/155
6,298,946 B1 * 10/2001 Yemini ..... B25H 1/06 182/153
8,702,046 B2 * 4/2014 Cooper ..... B60R 11/02 248/125.8
2005/0199443 A1 * 9/2005 Slavich ..... B25H 1/04 182/153
2005/0230188 A1 * 10/2005 Berg ..... B25H 1/06 182/153
2005/0279260 A1 * 12/2005 Stanford ..... A47B 13/021 108/115
2008/0236945 A1 * 10/2008 Larouche ..... B25H 1/06 182/153
2010/0288585 A1 * 11/2010 Katz ..... B25H 1/04 182/155
2015/0007756 A1 * 1/2015 Kollreider ..... A47B 9/20 108/21
2016/0249737 A1 * 9/2016 Han ..... A47B 9/14 108/145
2017/0312909 A1 * 11/2017 Brunner ..... B25H 1/16
2018/0207788 A1 * 7/2018 Brunner ..... B25H 1/06
2019/0047136 A1 * 2/2019 Maresca ..... B25H 1/06

* cited by examiner

*Primary Examiner* — Joseph J Hail
*Assistant Examiner* — Timothy Brady
(74) *Attorney, Agent, or Firm* — Tue Nguyen

(57) ABSTRACT

A workstand support can have a height adjustment mechanism using a multi point locking system for simultaneously lock and unlock multiple locations in the height adjustment mechanism. Latch configurations of the multi point locking system can provide high surface areas for higher load support. Snap latches and spring loaded assemblies can provide means to secure the multi point locking system. Folded legs can reduce storage space for the workstand support.

19 Claims, 23 Drawing Sheets

Forming a support having a simple height adjustment mechanism with heavy load support, lockable height adjustment, and foldable configuration
500

*FIG. 5A*

Forming a support having a top portion and a bottom portion, coupled together through two linear guide,
wherein the bottom portion has a multi point locking system for securing the top portion to the bottom portion,
wherein the bottom portion has foldable legs
520

*FIG. 5B*

Forming a support having a top portion and a bottom portion, wherein the top portion has two top parallel components configured to be slidable with two bottom parallel components of the bottom portion,
wherein the support has a multi point locking system coupled to the bottom portion,
wherein the multi point locking system has a handle for pushing or pulling two latch elements for securing or for releasing the top parallel components to the bottom parallel components,
wherein the bottom portion has foldable legs
540

*FIG. 5C*

Forming a support, wherein the support has a multi point locking system,
wherein the multi point locking system is coupled to a first portion of the support,
wherein the multi point locking system has a handle coupled to two rods disposed at two opposite ends,
wherein each rod is coupled to a latch configured to mate to one of multiple recesses in a second portion of the support for securing the second portion to the first portion.
1000

*FIG. 10A*

Forming a support, wherein the support has a first portion slidably coupled to a second portion,
wherein the first portion has a multi point locking system,
wherein the multi point locking system has two latches disposed at two opposite ends,
wherein the two latches are coupled to a control element for activating or deactivating the latches,
wherein in the activation configuration, the latches are configured to mate to recesses of multiple recesses in the second portion to prevent the second portion from sliding relative to the first portion,
wherein in the deactivation configuration, the latches are configured to be released from the recesses to allow the second portion to slide relative to the first portion.
1020

*FIG. 10B*

Forming a support, wherein the support has a first portion slidably coupled to a second portion,
wherein the support has a spring-like component configured to move the first portion away from the second portion,
wherein the first portion has a multi point locking system to prevent the second portion from moving away from the first portion.
1040

*FIG. 10C*

Forming a support, wherein the support has a first portion and a second portion,
wherein the first portion has two first elements slidably coupled to two second elements of the second portion,
wherein the support has multi point locking system,
wherein the multi point locking system has two latches configured to allow or to prevent sliding movements of the first elements relative to the second elements,
wherein a latch is configured to secure between 25 vol% to 50 vol% at one side of a first element or a second element.
1100

*FIG. 11A*

Forming a support, wherein two first elements of a first portion of the support are slidably coupled to two second elements of the second portion of the support,
wherein the support has two latches configured to allow or to block sliding movements of the first elements relative to the second elements,
wherein a latch is configured to secure a front side and a back side of a first element, wherein the front side of the first element is facing the front side of the other first element.
1120

*FIG. 11B*

Forming a support, wherein two first elements of the support are slidably coupled to two second elements portion of the support,
wherein the support has two latches configured to allow or to block sliding movements of the first elements relative to the second elements,
wherein the first elements have a hollow interior with a surrounding material at contact areas with the latches.
1140

*FIG. 11C*

Forming a support, wherein the support has two first elements slidably inside two second elements,
wherein the support has multi point locking system,
wherein the multi point locking system has two latches,
wherein the latches are configured to be in an engaged state or a disengaged state,
wherein in the engaged state, the latches are positioned in recesses in the first elements and slits in the second elements to prevent sliding movements of the first elements relative to the second elements,
wherein in the disengaged state, the latches are withdrawn from the recesses to allow sliding movements of the first elements relative to the second elements
1400

*FIG. 14A* wherein the latches are coupled to two rod assemblies, wherein the rod assemblies are coupled to a rotatable element, wherein when the rotatable element rotates, the rod assemblies extend or retract to move the latches between engaged and disengaged states.
1420
wherein the latches are coupled to two rod assemblies, wherein the rod assemblies are coupled to a linear movement element, wherein when the linear movement element moves, the rod assemblies extend or retract to move the latches between engaged and disengaged states.
1421

*FIG. 14B* wherein the latches are coupled to two rod assemblies, wherein in the engaged state, the rod assemblies form a straight line for locking the latches from accidently being released.
1430

*FIG. 14C* wherein each latch is coupled to a rod assembly,
wherein the support has linear guides,
wherein each linear guide is configured to guide a rod of the rod assembly so that the rod moves in desired directions between engaged and disengaged states.
1440

*FIG. 14D* wherein each latch is coupled to a rod assembly,
wherein the rod assembly is coupled to a spring,
wherein the spring is configured to bias the latch to the engaged state.
1450

*FIG. 14E* wherein each latch is coupled to a rod assembly,
wherein the rod assembly is coupled to a first snap mechanism,
wherein the first snap mechanism is configured to secure the latch to the engaged state,
wherein the rod assembly is coupled to a second snap mechanism,
wherein the second snap mechanism is configured to secure the latch to the disengaged state.
1460

*FIG. 14F*

Forming a support, wherein the support has a first portion and a second portion, wherein the first portion has two first elements connected through a second element in a plane, wherein the second portion has two third elements connected through a fourth element in a plane, wherein the first elements are slidably coupled to the third elements, wherein the support has multi point locking system, wherein the multi point locking system has two latches configured to allow or to prevent sliding movements of the first elements relative to the second elements,
wherein the second portion has two legs foldably extended from the third elements
1800

*FIG. 18A* wherein a first element of the first elements has a hinge coupling the first element to the second element, wherein the hinge allows the first element to be folded parallel to the second element,
wherein the second element has a hinge to allow the second element to be folded,
wherein a third element of the third elements has a hinge coupling the third element to the fourth element, wherein the hinge allows the third element to be folded parallel to the fourth element,
wherein the fourth element has a hinge to allow the fourth element to be folded.
1820

*FIG. 18B* wherein a first element of the first elements has a hinge coupling the first element to the second element, wherein the hinge allows the first element to be folded parallel to the second element,
wherein a third element of the third elements has a hinge coupling the third element to the fourth element, wherein the hinge allows the third element to be folded parallel to the fourth element,
wherein the fourth element has a hinge to allow the fourth element to be folded.
1840

*FIG. 18C*

Forming a support, wherein the support has two first portions slidably coupled to two second portions,
wherein the support has a first moving mechanism having a multi point locking system,
wherein the first mechanism is configured to secure the first portions to the second portions at discrete locations,
wherein the support has a second moving mechanism having a rotational-to-linear conversion,
wherein the second mechanism is configured to secure the first portions to the second portions at continuous locations.
2000

*FIG. 20A*

Forming a support, wherein the support has two first portions slidably coupled to two second portions,
wherein each of the first portions has multiple discrete recesses,
wherein the support has a multi point locking system coupled to the second portions,
wherein the multi point locking system has two latches configured to mate with two of the multiple discrete recesses of the two first portions to prevent sliding movements of the first portions relative to the second portions,
wherein the support has two rotational-to-linear coupling,
wherein the rotational-to-linear coupling are coupled to the first portions and the second portions,
wherein the rotational-to-linear coupling are configured to move the first portion relative to the second portion continuously between two discrete recess positions
2020

*FIG. 20B*

Adjust a height of a support discretely, followed by continuously
2040

*FIG. 20C*

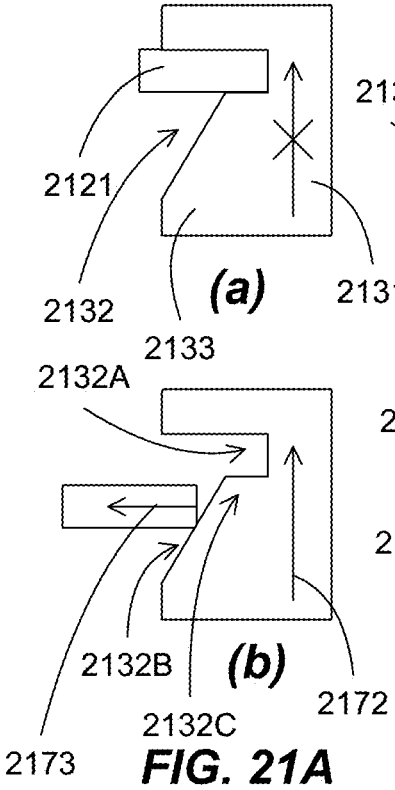
FIG. 21A
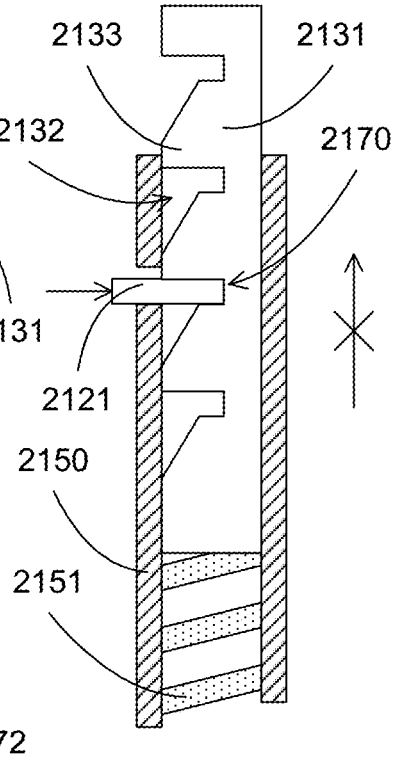
FIG. 21B
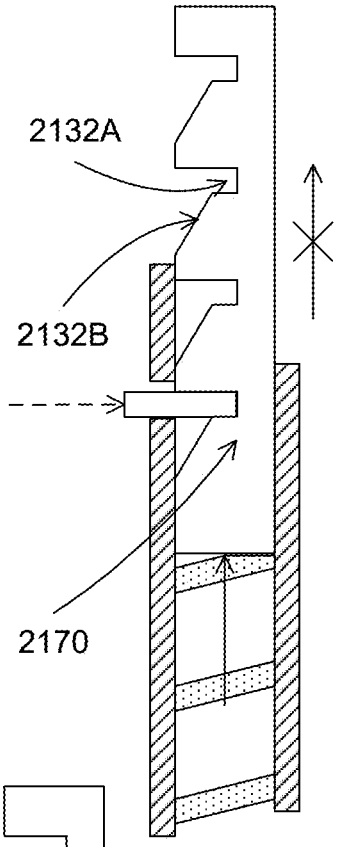
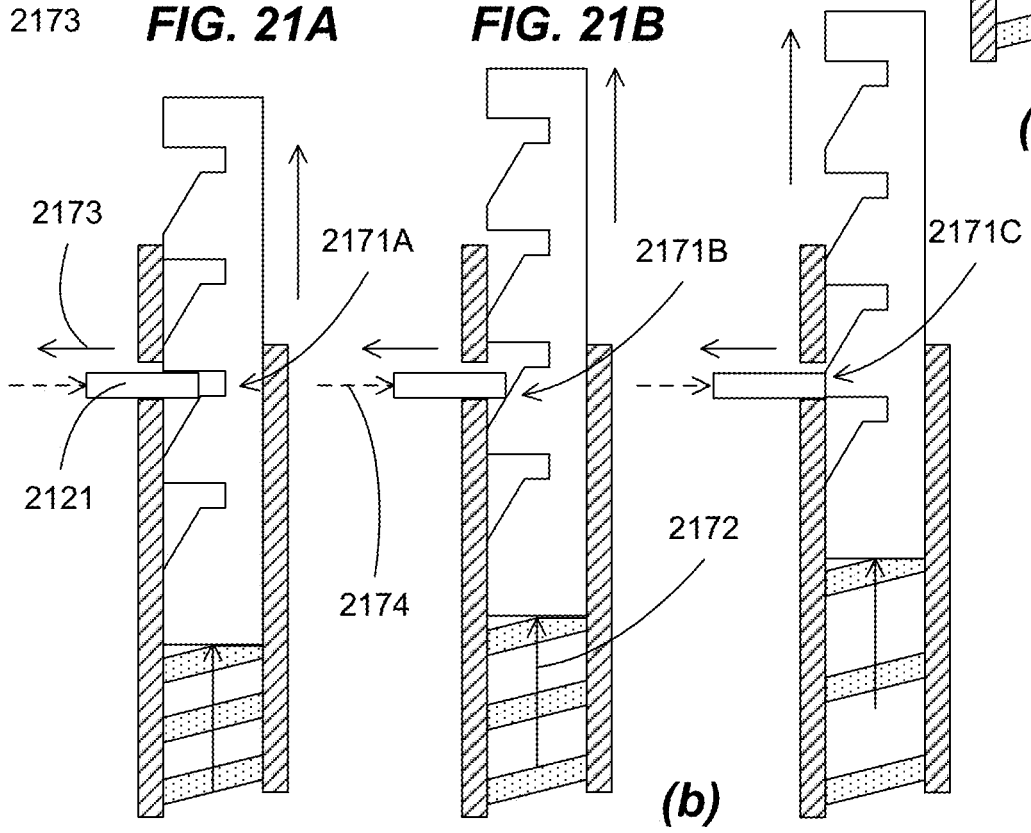
(a) FIG. 21C (c)

HEIGHT ADJUSTABLE WORKSTAND SUPPORT

The present patent application claims priority from U.S. Provisional Patent Applicant Ser. No. 63/007,369, filed on Apr. 9, 2020, entitled "Height adjustable workstand support", of the same inventors, hereby incorporated by reference in its entirety.

BACKGROUND OF THE INVENTION

Work stands are used to support the workpieces for ease of services. For example, a worker can have a workpiece on a stand so that the workpiece can be at an eye level for side works or can be at higher level for working underneath the workpiece.

FIGS. 1A-1D illustrate prior art support stands. FIG. 1A shows a support stand 100 having a fixed height, which can be simple and inexpensive to manufacture. The fixed height stands can include a top bar 130 disposed on two sets of legs 140. A work platform can be disposed on two support stands for supporting a workpiece.

There is a need for ergonomic environment, such as the needs for prevent stress and fatigue in workers working all day on a work platform. Thus, the work stands should be configured to provide proper heights for the workers. For example, the work surfaces should be adjustable to adapt to varying applications and to accommodate workers of various statures and work height preferences.

Adjustable height work stands can include sets of 2 vertical beams forming a base, which can be removably and adjustably coupled to a top portion. Thus, the top portion can be removed from the base, and then reattached at a different vertical level to provide a different height for the work stand.

FIG. 1B shows a support stand 101 having an adjustable height. The work stand 101 can include a top portion having a top bar 131 coupled to two top leg portions 151. A cross bar 171 can be used to strengthen the top portion. The top leg portion 151 can be slidably coupled to bottom leg portions 141, for example, using concentric tubes for the top and bottom leg portions. A locking mechanism 161 can be used to secure the top and bottom leg portions together. For example, the locking mechanism 161 can include a screw passing through the top leg portion and pushing on the bottom leg portion. The locking mechanism 161 can further include a handle to rotate the screw, allowing the top and bottom leg portions to be secured together, or to be loosened to adjust the height of the stand.

In operation, the locking mechanism 161 can be loosened, e.g., two handles on both leg portions are turned, for example, counter clockwise, to loosen the screws used to tightening the leg portions. The top leg portion 151 can be lifted up, relative to the bottom leg portion 141 until the work stand 101 has a desired height. The locking mechanism 161 can then be tightened, to keep the work stand 101 at the set height.

FIG. 1C shows a support stand 102 having an adjustable height. The work stand 102 can include a top portion having a top bar 132 coupled to two top leg portions 152. The top leg portions 152 can be movably coupled to bottom leg portions 142, for example, using angle plates such as C beams for strength. One or more cross bars 172 can be used to strengthen the top portion. A locking mechanism 162 can be used to secure the top and bottom leg portions together. For example, the top leg portions can have multiple holes 182A which can be mated to slits 182B on the bottom leg portions. Screw sets can pass through the slits and the holes to secure the top and bottom leg portions together.

In operation, the locking mechanism 162 can be loosened, e.g., the screws are loosened. The top leg portions can slide relative to the bottom leg portions until the work stand 102 has a desired height. The screws then can be tightened, to keep the work stand 102 at the set height. Alternatively, the screws can be removed completed to select different holes on the top leg portions, and then retightened using different hole locations.

FIG. 1D shows a support stand 103 having an adjustable height. The work stand 103 can include a top portion having a top bar 133 coupled to two top leg portions 153. The top leg portions 153 can be movably coupled to bottom leg portions 143, for example, using angle plates such as C beams for strength. One or more cross bars 173 can be used to strengthen the top portion. A locking mechanism 163 can be used to secure the top and bottom leg portions together. For example, the top leg portions can have multiple slits 183A which can be mated to slits 183B on the bottom leg portions. Screw sets can pass through the splits to secure the top and bottom leg portions together.

In operation, the locking mechanism 163 can be loosened, e.g., the screws are loosened and removed. The top leg portions can slide relative to the bottom leg portions until the work stand 102 has a desired height. The screws then can be reinstalled and tightened, to keep the work stand 102 at the set height.

SUMMARY OF THE EMBODIMENTS

In some embodiments, the present invention discloses adjustable height workstand supports to provide work surfaces that can accommodate statures and work height preferences of different workers. The workstand support can include a multi point locking system, using latches engaging with teeth on tooth racks. The multi point locking system can be easy to operate, which can motivate the workers to adjust the height of the workstand supports to ensure that the workpiece stays at a desirable working height.

In some embodiments, the multi point locking system can have latch configurations offering high surface area contact for high load capability. The surface area contact can be well distributed to further increase the load capability.

In some embodiments, the multi point locking system can include snap locks and spring-loaded actuators, to securing the locking configuration and the unlocking configuration, to prevent accidental state transfer, such as by vibration of the workpieces or from the work environment.

In some embodiments, the workstand support can have a foldable configuration for reducing storage space. The workstand support can be folded into a plane or into a column configuration, through an arrangement of hinges.

In some embodiments, the workstand support can have a continuous and a discrete height adjustment. A tooth rack configuration can allow discrete adjustments, in which the height of the workstand support can be adjusted at discrete levels corresponded to the teeth on the tooth rack. A turnbuckle configuration can allow continuous adjustments, by turning a handle for rotating components of the turnbuckle to gradually move a top portion of the workstand support relative to a bottom portion.

BRIEF DESCRIPTION OF THE DRAWINGS

FIGS. 5A-5C illustrate workstand configurations according to some embodiments.

FIGS. 10A-10C illustrate processes to form workstand supports having a multi point locking system according to some embodiments.

FIGS. 11A-11C illustrate processes to form workstand supports having a multi point locking system according to some embodiments.

FIGS. 14A-14F illustrate workstand support having a multi point locking system according to some embodiments.

FIGS. 18A-18C illustrate processes to form foldable workstand supports according to some embodiments.

FIGS. 20A-20C illustrate processes to for height adjustment according to some embodiments.

FIGS. 21A-21C illustrate a configuration for a locking mechanism between the top upright members and the bottom upright members according to some embodiments.

DETAILED DESCRIPTION OF THE EMBODIMENTS

In some embodiments, the present invention discloses adjustable height workstand supports, which can be used to provide work surfaces with adjustable height to accommodate statures and work height preferences of the workers. The workstand support can include two sets of upstanding support members, connected through connecting members. Each set of the upstanding support members can include a top member slidably coupled to a bottom member. For example, a set of support members can include a composite member, which can include a top square or rectangular tube, which is slidably fitted inside or outside a bottom square or rectangular tube. By sliding along the length of the tubes, the total height of the composite member can be changed. For example, when the top tube slides deeply inside the bottom tube, the total height of the composite member can be shortened. When the top tube slides outwardly away from the bottom tube, the total height of the composite member can be lengthened. A locking mechanism can be included to secure the composite members at the desired height.

In some embodiments, the workstand supports can be easy to operate, e.g., the workstand supports are designed to facilitate the height adjustment procedures and adjustability. The ease of height adjustment can provide motivation for the workers to adjust the height of the workstand supports to ensure that the workpiece stays at a desirable working height. Further, the workstand supports can sturdily supports a heavy workpiece placing on the workstand supports, e.g., the workstand supports are designed to maintain an optimal rigidity and reliability. For example, the locking mechanism is configured to secure the top and bottom members to form a composite member able to withstand heavy load.

In some embodiments, the workstand supports can be foldable, e.g., can be easily folded to take up little space for storage. For example, in its working states, the workstand support can be spread out, such as having spread out sub legs from a main leg, for increased stability. In the storage states, the workstand support can be folded into a planar or columnar configuration, which can occupy minimum space in the storage.

Figure 1A:
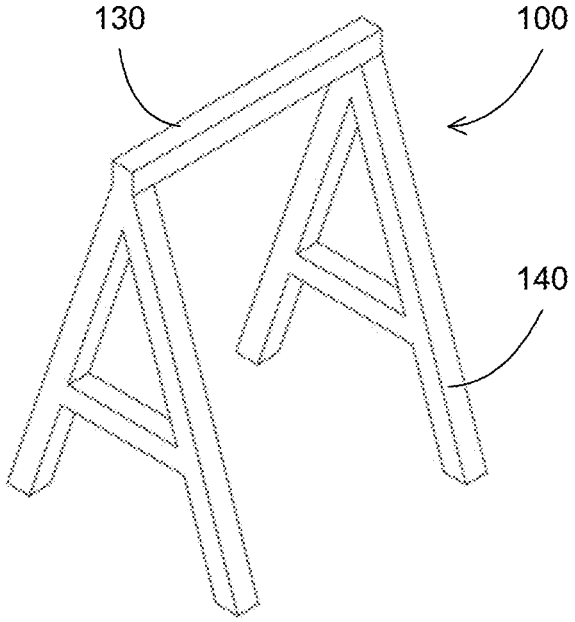
FIGS. 1A-1D illustrate prior art support stands.
Figure 1B:
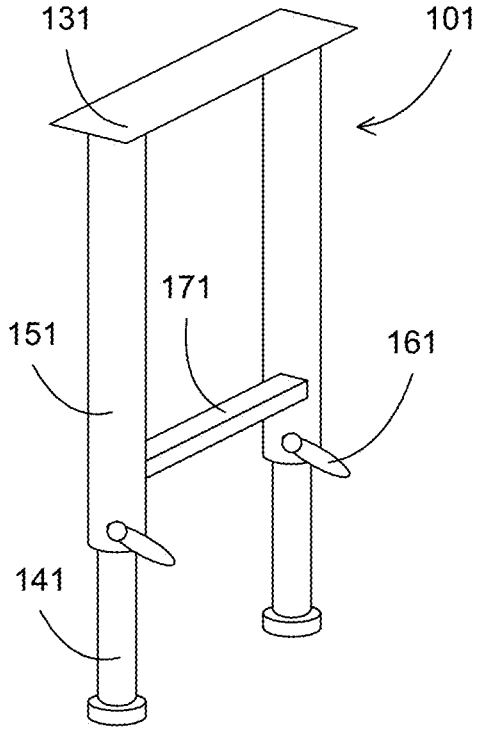
Figure 1C:
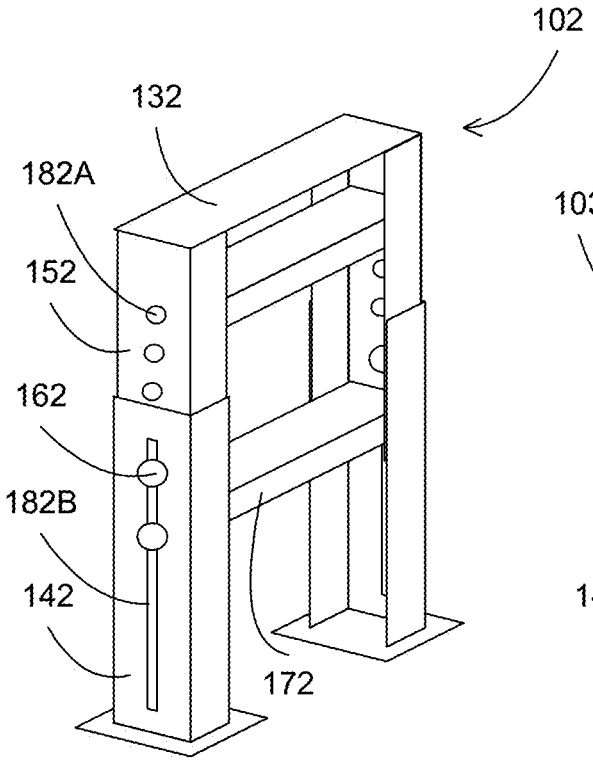
Figure 1D:
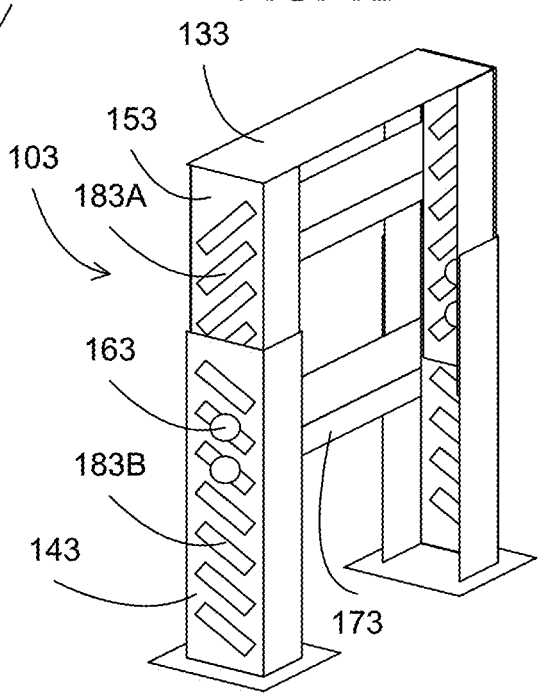
FIG. 1D (Prior Art)
Figure 2A:
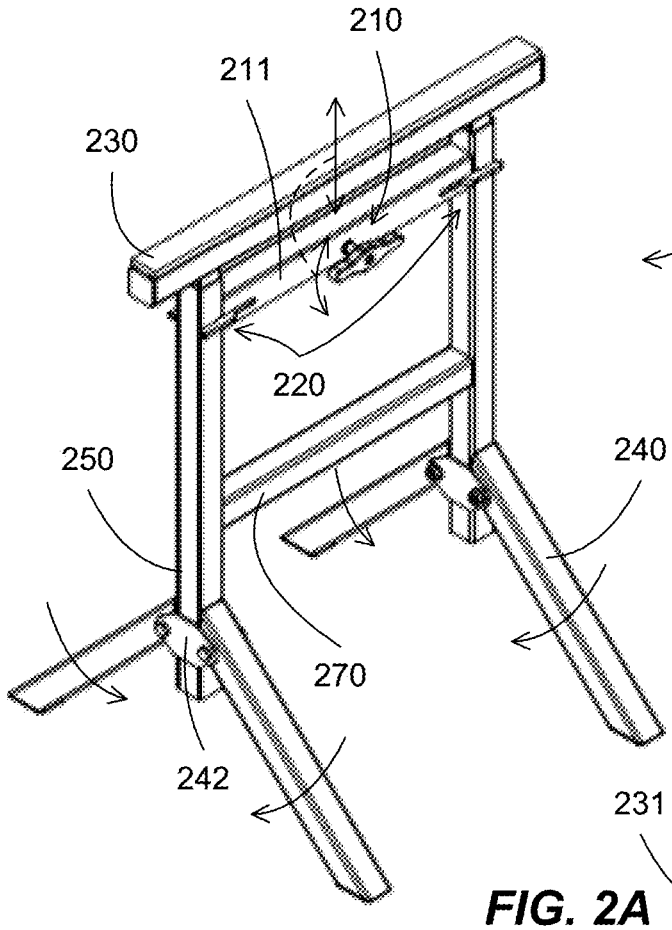
FIGS. 2A-2B illustrate a workstand support according to some embodiments.
Figure 2B:
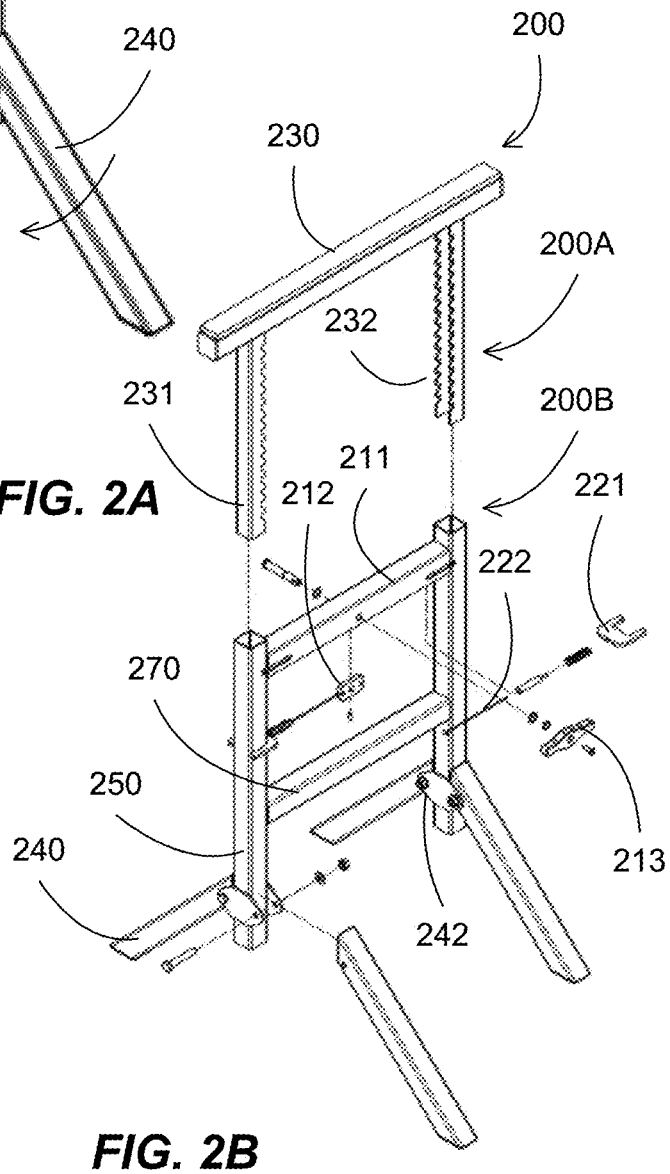

FIGS. 2A-2B illustrate a workstand support according to some embodiments. A workstand support 200 can include a top portion 200A having a horizontal member 230, such as beam disposed in a plane parallel to the ground. A work surface can be disposed on the horizontal beam 230, for example, on two horizontal beams of two workstand supports disposed next to each other. A layer having a soft material can be placed on the horizontal member 230, for example, to protect the work surface. The top portion can include two top upright members 231, such as square angle beam, e.g., square or rectangular tube or C or I cross section beam. The two top upright members 231 can be parallel to each other, and can form a square angle with the horizontal member 230. The top upright members 231 and the horizontal member 230 can be in a planar configuration, e.g., forming a flat plane.

The workstand support 200 can include a bottom portion 200B having two bottom upright members 250, connected with a connection member 270. Additional connection members can be included, such as connection member 211.

The two bottom upright members 250 can have a cross section matching with the cross section of the top upright members 231. The matching is such that the top upright members can slide along the bottom upright members. For example, the top upright members can be slidable inside or outside the bottom upright members.

For example, if the top upright members have a C cross section, the bottom upright members also can have a square cross section, which can be larger or smaller to accommodate the top upright members. As shown, the bottom upright members 250 have a hollow square cross section, which can accommodate the C cross section top upright members, e.g., the top upright members 231 can be slidable inside the bottom upright members 250. Alternatively, the bottom upright members can have a C cross section, with the top upright members slidably disposed inside. Alternatively, the bottom upright members can have other cross sections, such as square or rectangular or C or I cross section configuration.

The two bottom upright members 250 can be parallel to each other, and can form a square angle with the connection member 270. The bottom upright members 250 and the connection member 270 can be in a planar configuration, e.g., forming a flat plane.

The connection members are configured to secure the bottom upright members 250, for example, keeping the bottom upright members in a parallel configuration, having a separation matching the separation of the two top upright members 231.

The bottom upright member 250, e.g., the trunk or the main legs of the workstand support, can be foldably coupled to sub legs 240, e.g., the legs of the workstand support, through hinges 242. For example, a hinge 242 can include two plates fixedly coupled, such as welded, to a bottom upright member 250. A pin can pass through the plates and a leg 240, with the two plates sandwiching the leg. The pin can be positioned so that the leg 240 can be foldable to be parallel to the bottom upright member 250. There can be two pins for two legs for one bottom upright member 250.

The workstand support 200 can include a locking mechanism 210 disposed in a connection member 211. The connection member 211 can have a C cross section, e.g., having the bottom portion opened to the atmosphere to accommodate a rotation of an element 212 of the locking mechanism 210.

The locking mechanism 210 can include a multi point locking system 220, e.g., a movement of the locking mechanism 210, such as a rotation of a handle 213, can simultaneously lock and unlock at least two locations, e.g., moving two latches 221 to engage or disengage the two top upright members with the two bottom upright members. The multi point locking system can significantly simplify the height adjustment procedure of the workstand support, which can simultaneously engage or disengage two main legs of the workstand support at a same time, using one motion. A workstand support can have two main legs, e.g., two upright support members as the main support structure for the stand. Other legs, e.g., sub legs as compared to the main legs, can extend from the main legs when touching the ground or the work surface, to provide stability for the workstand support. Using a multi point locking system, the top portion 200A can be locked to or unlocked from the bottom portion 200B simultaneously, instead of one after the other.

For example, rod assemblies including rods 222 can connect the elongated rotating element 212. The other ends of the rod assemblies can be coupled to the latches 221. When the handle 213 rotates, the elongated rotating element 212 also rotates, pushing or pulling the latches 221. When the latches are pushed, the latches can engage to the recesses 232 in the top upright members, which can prevent the top upright members from being able to slide inside the bottom upright members 250. When the latches are pulled, the latches can be disengaged from the recesses 232, which can allow the top upright members to be able to slide inside the bottom upright members 250, and thus allowing the adjustment of the height of the workstand support.

In operation, the workstand support 200 can have a height adjusted, e.g., changing the distance between the horizontal beam 230 to the ground. A worker can rotate the handle 213 to release the latches on the top upright members 231. The top portion 200A can be freely moved, e.g., slidable along the bottom upright members. To achieve a larger distance, e.g., a higher height, the top portion 200A can be pulling out further from the bottom upright members. To achieve a smaller distance, e.g., a lower height, the top portion 200A can be pushing further into the bottom upright members.

After achieving a desired height, the worker can release the handle or can rotate the handle in an opposite direction to engage the latches to the top upright members, which secure the top upright members to the bottom upright members.

Figure 3A:
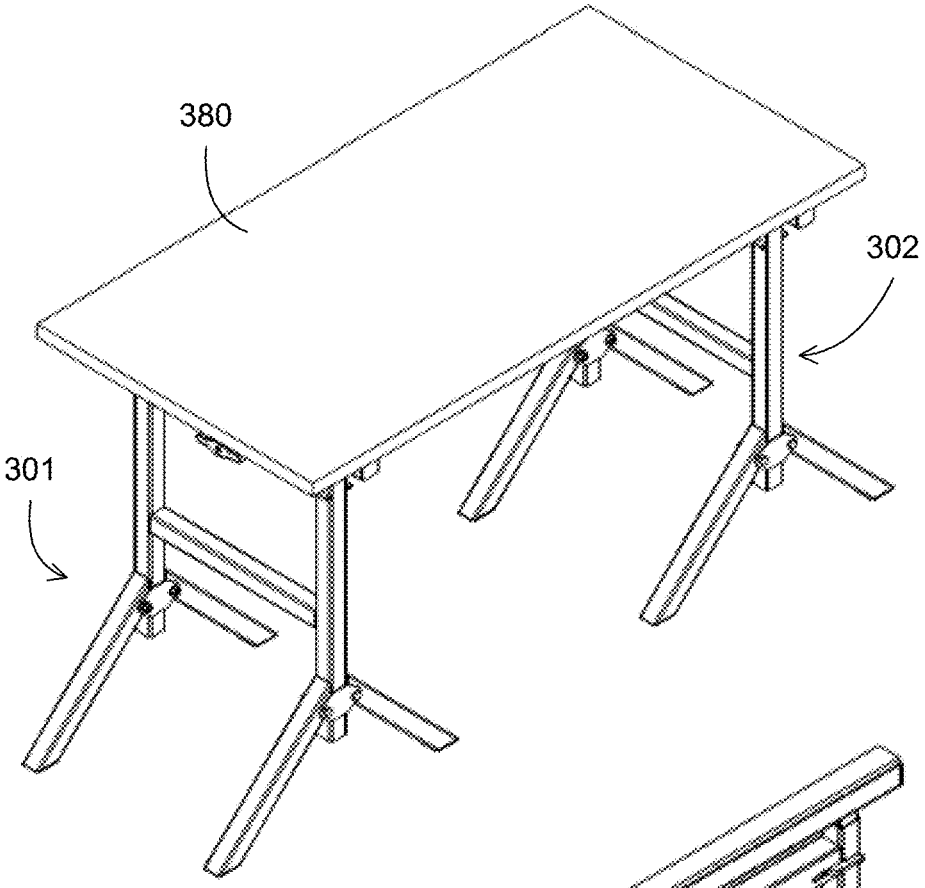
FIGS. 3A-3B illustrate operating configurations for a workstand support according to some embodiments.
Figure 3B:
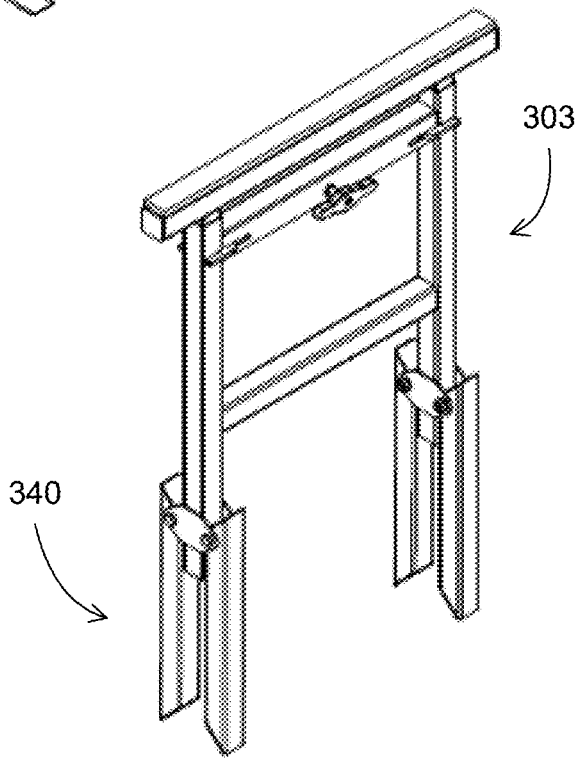

FIGS. 3A-3B illustrate operating configurations for a workstand support according to some embodiments. FIG. 3A shows a working condition using two workstand supports 301 and 302. A work surface 380 can be placed on the workstand supports 301 and 302. The heights of the workstand supports 301 and 302 can be adjusted to accommodate a worker stature and work condition preferences. After adjusting the heights, the work surface 380 can be placed on the workstand supports. The workpieces can be placed on the work surface 380, and the worker can start working at the workpieces.

FIG. 3B shows a storage configuration of a workstand support 303. The top portion can be pushed down into the second portion, to form a workstand support having a minimum height. The legs can be folded 340, to be parallel to the upright members. In the storage configuration, the workstand support can be stored flat with a lot less storage space.

Figure 4A:
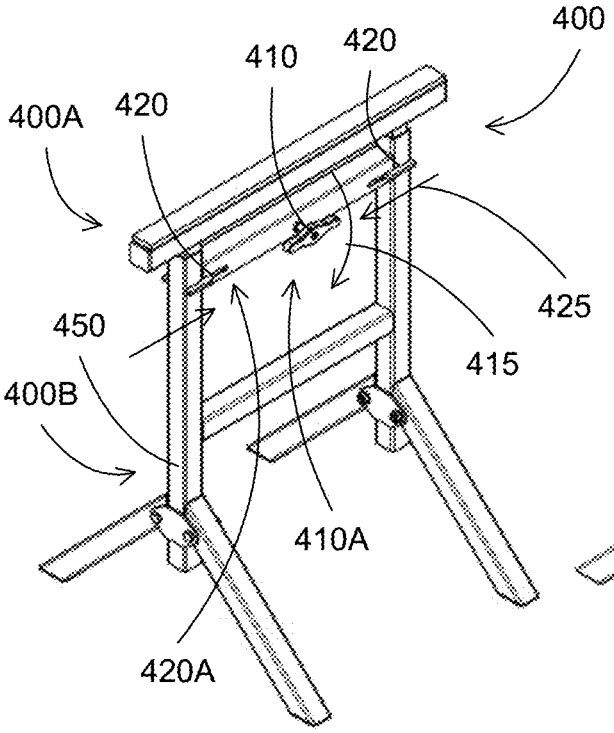
FIGS. 4A-4D illustrate a process for a height adjustment of a workstand support according to some embodiments.

FIGS. 4A-4D illustrate a process for a height adjustment of a workstand support according to some embodiments. In FIG. 4A, the workstand support 400 can have a minimum height, e.g., the top portion 400A is pushed all the way into the second portion 400B, e.g., the top upright members 431 is completely inside the bottom upright member 450, so that the horizontal member 430 is touching or very close to the bottom upright members 450.

A locking mechanism 410 is in locking state 410A, meaning the multi point locking system 420 is in an engaged state 420A for securing the top portion to the bottom portion.

To adjust the height, the handle 413 can be rotated, for example, in a clockwise direction 415. The rotation 415 of the handle 413 can pull 425 on the multi point locking system to release the latches, thus the top portion can freely move relative to the bottom portion.

Figure 4B:
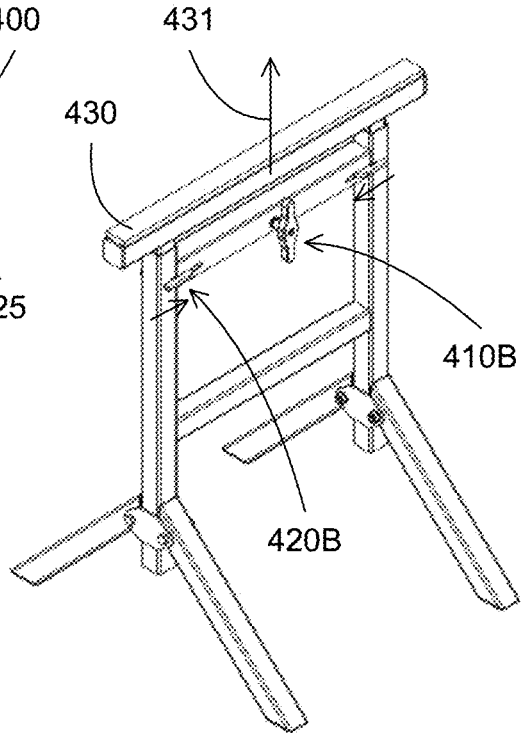

In FIG. 4B, a higher height of the workstand support is desired. Since the locking mechanism is now in unlocking state 410B, meaning the multi point locking system is in a disengaged state 420B, the top portion can freely move away from the bottom portion, e.g., the top upright members can be slidably moved along the bottom upright members.

The top portion can be pulled up 431, for example, by lifting the horizontal member 430, until a desired height is reached.

Figure 4C:
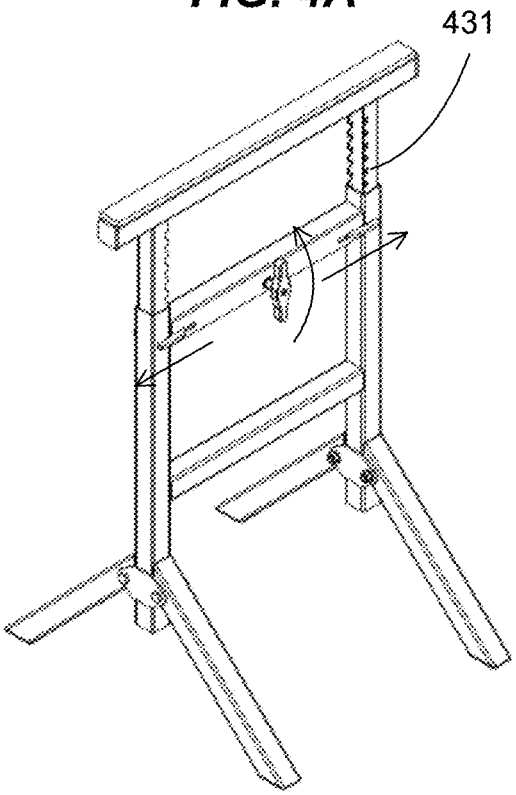

In FIG. 4C, the desired height is achieved. The handle can be turned, for example, counter clockwise, to re-engage the 2-point lick mechanism for latching the top portion to the bottom portion.

Figure 4D:
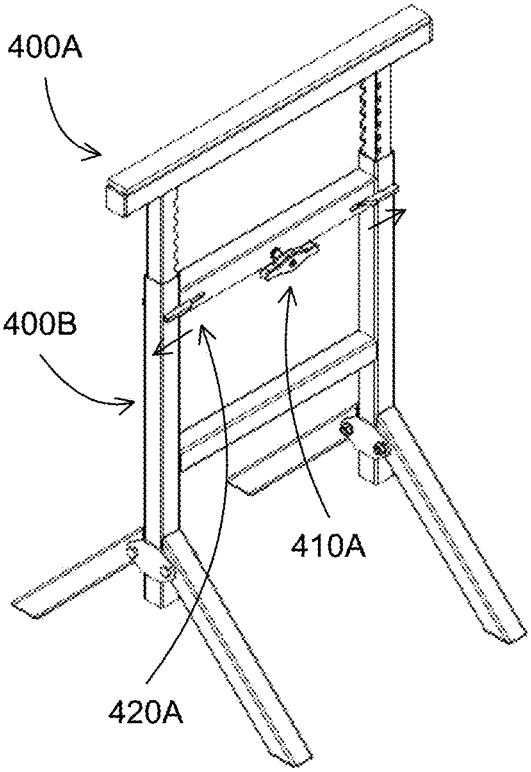

FIG. 4D shows a final configuration after the height is adjusted, and the workstand support is ready to be used. The locking mechanism is in the locking state 410A, and the multi point locking system is in the engaged state 420A.

FIGS. 5A-5C illustrate workstand configurations according to some embodiments. In FIG. 5A, operation 500 forms a workstand support having a simple height adjustment mechanism with heavy load support, lockable height adjustment, and foldable configuration. The simple height adjustment mechanism can include a multi point locking system, which can simultaneously act on multiple support members for locking and unlocking. The multi point locking system can also allow the workstand support to have the work surface adjusted, instead of sequentially adjusting portions of the work surface. For example, by deactivating the multi point locking system, locking on all main legs of the workstand support is disengaged together, which can allow the top surface of the workstand to be raised up or lowered down.

The workstand support can support heavy load through a latch configuration that can support the top portion of the workstand support at a large area, which can allow the heavy load to spread out to reduce the impact on the height adjustment mechanism. For example, the latch configuration can support the top portion at more than 25% of the upright members of the top portion, or can support the top portion at distributed areas, such as at front, side, and back areas.

The workstand support can include a lockable configuration for the height adjustment mechanism, which can prevent the height adjustment mechanism to be accidentally disengaged from the engaged state, for example, due vibration or collision. The multi point locking system can push, for example, two latches into a locking or engaged position. The pushing element can include a straight beam connecting the two latches, thus the latches, when engaged, can be locked in the engaged stated. A spring element or an actuator can also be used to provide the pushing forces on the latches in the engaged state.

The workstand support can include a foldable configuration for reducing storage space. The legs, e.g., the sub legs extended from the main legs or the upright support members, can be folded, e.g., rotated, to be parallel to the main legs. Thus, in the folded configuration, the workstand support can be stored flat, e.g., the upright members and the connection members form a plane and the sub legs are disposed parallel with this plane.

In FIG. 5B, operation 520 forms a workstand support having a top portion and a bottom portion, coupled together through two linear guides. For example, the top portion can include top upright members, which are slidably coupled to bottom upright members of the bottom portion. The top upright members can include square tubes or C cross section tube, which can be disposed inside the bottom upright members, which can include hollow square tubes, having cross sectional area slightly larger than the cross sectional area of the top upright members, so that the top upright members can be slidably moved inside the bottom upright members.

The bottom portion can have a multi point locking system for ease of securing the top portion to the bottom portion. The multi point locking system can simplify the procedure to adjust the height of the workstand support, e.g., one operation can simultaneously lock or unlock both latches that are used to secure the top portion to the second portion.

The bottom portion can have foldable legs, which can provide smaller storage space.

In FIG. 5C, operation 540 forms a workstand support having a top portion and a bottom portion. The top portion can have two top parallel components configured to be slidable with two bottom parallel components of the bottom portion. The workstand support can have a multi point locking system coupled to the bottom portion for ease of locking or unlocking the top and bottom portions. The multi point locking system can have a handle coupled to two latch elements. Activating the handle can for push or pull the latches, which can engage or disengage the top parallel components relative to the bottom parallel components.

The bottom portion can have foldable legs, which can provide smaller storage space.

Figure 6A:
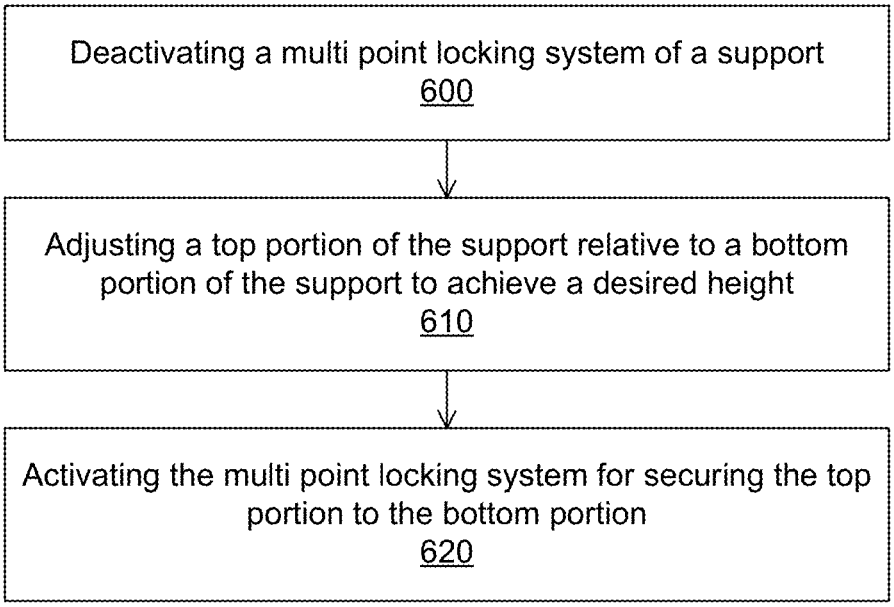
FIGS. 6A-6B illustrate operations of a workstand support according to some embodiments.
Figure 6B:
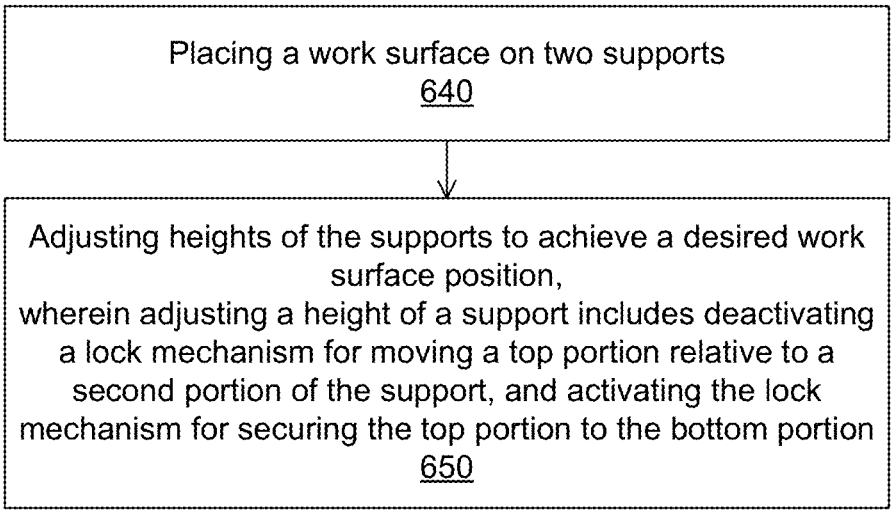

FIGS. 6A-6B illustrate operations of a workstand support according to some embodiments. FIG. 6A shows a procedure for adjusting a workstand support having a multi point locking system for simultaneously locking and unlocking multiple secured points between two portions of the workstand support. Operation 600 deactivates a multi point locking system of a workstand support. For example, the multi point locking system can have a handle, which can be used to activate or deactivate the multi point locking system. By acting on the handle, such as by rotating or by pushing the handle, multiple latches can be moved to change the states of the locking system.

After the multi point locking system is deactivated, the two portions of the workstand support can be freely moved relative to each other. Operation 610 adjusts a top portion of the support relative to a bottom portion of the support to achieve a desired height.

After the desired height for the workstand support is reached, operation 620 activates the multi point locking system for securing the top portion to the bottom portion.

FIG. 6B shows a procedure for using a workstand support. Operation 640 places a work surface on two workstand supports. Operation 650 adjusts the heights of the workstand supports to achieve a desired position for the work surface. Adjusting a height of a workstand support can include deactivating a lock mechanism for moving a top portion relative to a second portion of the workstand support, and activating the lock mechanism for securing the top portion to the bottom portion.

The height adjustment for the workstand supports can be performed before or after the work surface is placed on the workstand supports.

In some embodiments, the present invention discloses a workstand support having a multi point locking system for securing two movable portions of the workstand support. The separation distance between the two movable portions can determined the height of the workstand support, and the movable portions can allow the height to be adjusted.

The multi point locking system can secure multiple locations, such as 2 locations, of the portions of the workstand support together. The simultaneous action on the multiple locations can simplify the height adjustment procedure, for example, the height can be adjusted by deactivating the multi point locking system, followed by moving a portion relative to the other portion. Re-securing the two portions at the new height can be accomplished by re-activating the multi point locking system.

Figure 7A:
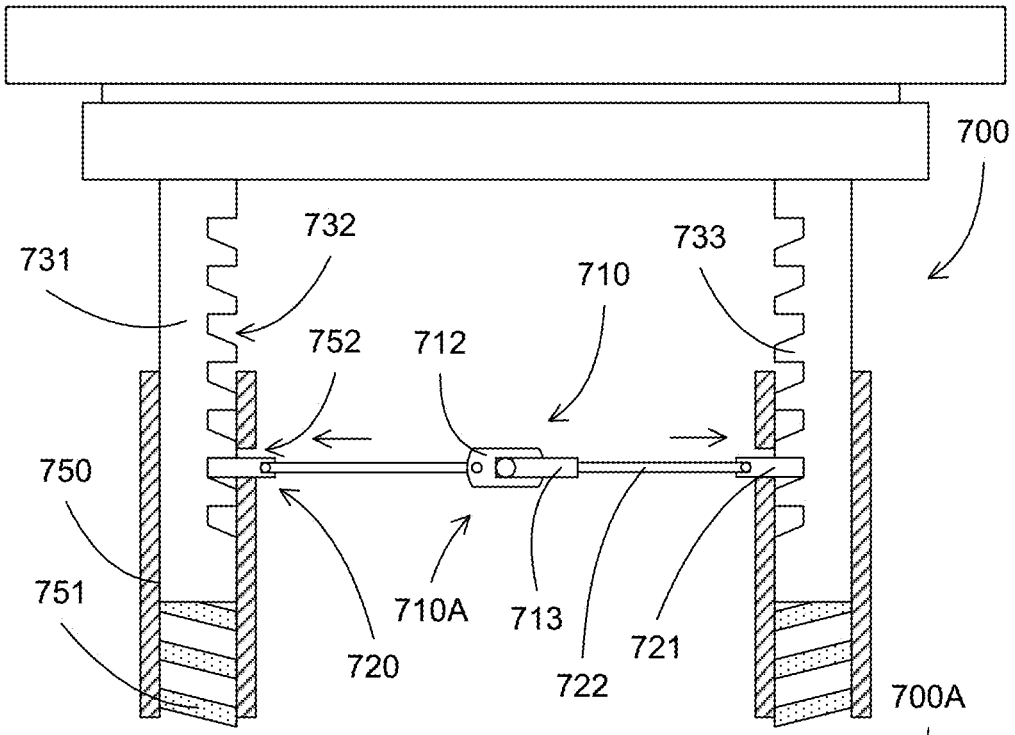
FIGS. 7A-7B illustrate operations of a multi point locking system in a workstand support according to some embodiments.
Figure 7B:
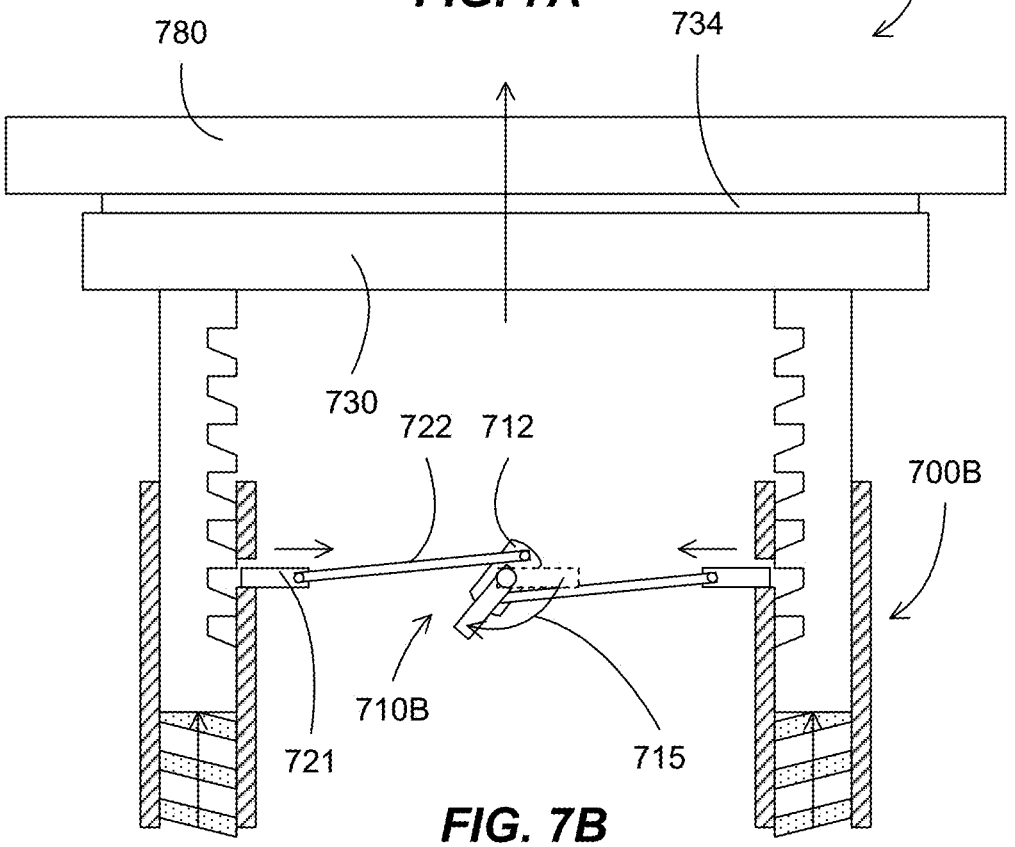

FIGS. 7A-7B illustrate operations of a multi point locking system in a workstand support according to some embodiments. FIG. 7A shows a locked or engaged state of the multi point locking system 710, in which the height of a workstand support 700 is fixed. FIG. 7B shows an unlocked or disengaged state of the multi point locking system 710, in which the height of the workstand support 700 can be adjusted.

The workstand support 700 can include a top portion 700A, which is movably coupled to a bottom portion 700B. A partial bottom portion 700B is shown, e.g., the bottom upright members 750 and the multi point locking system, together with a spring or actuator assembly 751 are shown, and the sub leg portion, the connection beam, and other portions are not shown.

The top portion 700A can include two top upright members 731, which are movably coupled to the bottom upright members 750 of the bottom portion 700B. As shown, the top upright members are disposed within the bottom upright members. For example, the top upright members can be square beams or beams having a C cross sectional area. The bottom upright members can be hollow square beams, with the inner dimensions slightly larger than the outer dimensions of the top upright members, to allow the top upright members to be slidable within the bottom upright members.

A horizontal member 730, such as a square beam, can be fixed coupled to the top upright members. A layer 734 of a soft material, such as a rubber sheet or a polymer sheet, can be adhered to a top surface of the horizontal member 730. The soft material can serve to prevent damage to the workpieces or to the work surface 780 disposed on the workstand support.

In some embodiments, the top upright members are disposed in parallel to each other, in order to be able to travel together to raise or to lower the horizontal member, e.g., to adjust the height of the workstand support. The horizontal member can be disposed perpendicular to the top upright members. The horizontal member and the top upright members can form a top plane, e.g., the members are arranged in the top plane, for example, to reduce storage space.

The workstand support can have multiple locking positions, which can be accomplished by the top upright members having multiple lockable positions. For example, the top upright members 731 can have a tooth rack 732 having multiple teeth 733. The teeth 733 can have a flat bottom surface, for mating with a top surface of latch 721. The teeth 733 can have a tilted top surface, to facilitate the mating process with the latch 721.

The bottom upright members 750 can be configured to accept the top upright members 731. For example, the top and bottom upright members can form a linear guide with the top upright members slidably coupled to the bottom upright members. The bottom upright members can have slits 752, which can be configured to accept the latches 721. For example, the latches 721 can enter the slits 752 to engage with the teeth 733 for locking the movements of the top upright members. The latches 721 can withdraw from the slits 752, e.g., completely withdrawn or partially withdraw from the slits, e.g., withdrawn from contacting the teeth of the tooth rack of the top upright members. In the withdrawn state, the top upright members can freely move relative to the bottom upright members.

A spring 751 or an actuator assembly can be coupled to the top upright members. The spring 751 can be configured to bias the top upright member upward, e.g., the spring can be in a compressed state to push the top upright member upward. Thus, without any constraint, the top upright members can move upward. For example, when the latches are withdrawn from the slits, e.g., not engaged with the teeth, the spring can push the top upright members upward. A worker can then push the horizontal member downward until a desired height is reached, before relocking the latches.

The workstand support can have a multi point locking system 710, which can include a handle 713 coupled to a rotating element 712. Rods 722 can be coupled to the rotating element 712 at one end. The other ends of the rods 722 can be coupled to the latches 721.

In the locked or engaged state 710A, the latches 721, the rods 722, and the rotating element 712 form a straight line, with the latches entering the slits 752 and engaging with the teeth 733 of the tooth rack 732 of the top upright members 731. In the locked state, the top upright members are secured to the bottom upright members, forming a workstand support with a desired height. The straight line configuration of the latches, the rods, and the rotating element can provide a locking configuration for the latches, meaning the latches are pushed to be secured with the teeth, which can somewhat prevent the latches from being loosened from the teeth, for example, due to vibration.

The handle can be rotated 715, for example, by a worker attempting to adjust the height of the workstand support. When the handle rotates, the rotating element 712 also rotates, which can pull the rods 722 and the latches 721 away from the teeth and the slits. The handle can rotate to an angle that can pull the latches away from the teeth, to clear the latches from the teeth, to allow the movements of the top upright member relative to the bottom upright members. In this unlocking or disengaged state 710B, the top upright member can move, for example, moving upward due to the bias of the loaded spring 751.

Figure 8A:
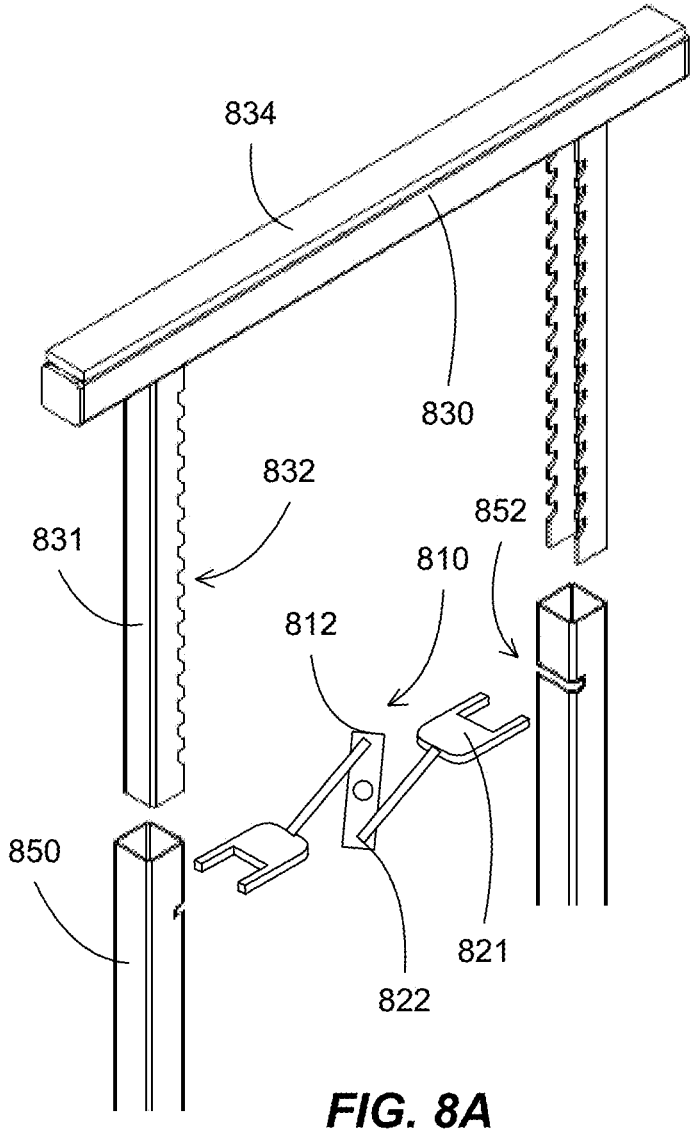
FIGS. 8A-8C illustrate different view of a multi point locking system in a workstand support according to some embodiments.
Figure 8B:
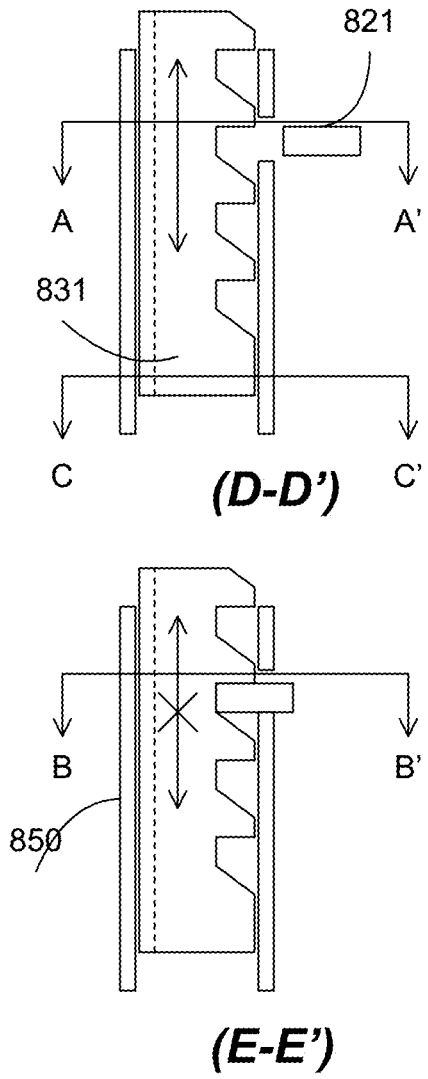
Figure 8C:
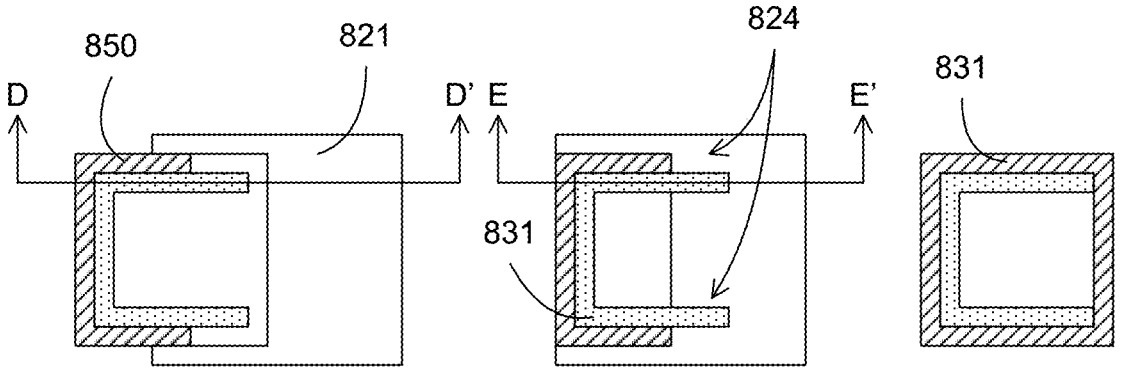

FIGS. 8A-8C illustrate different view of a multi point locking system in a workstand support according to some embodiments. FIG. 8A shows a perspective view of a portion of the workstand support, including the multi point locking system 810 in the unlocked or disengaged state. The workstand support can include top upright members 831 connected to a horizontal member 830. A layer 834 of soft material, e.g., softer than steel or aluminum, can be disposed on the horizontal member 830.

The top upright member 831 can have a C shape cross section, such as a member having three sides with the fourth side open. The top upright members can have tooth racks 832 with multiple teeth which are configured to be mated with the latches 821 of the multi point locking system 810.

The bottom upright members 850 can have a hollow square cross section, such as square tubes. The tubes should be large enough for a snug fit with the top upright members, e.g., the top upright members can slide easily along the length of the bottom upright members with little or no side forces or movements.

The bottom upright members 850 can have slits 852, which can be configured for the latches 821 to enter the bottom upright members to engage with the teeth of the tooth rack 832. The slits can run along one side, and can penetrate between 20% to 50% of other sides. The size of the slits can be based on the amount of penetration of the latches into the bottom upright members.

The multi point locking system 810 includes two latches 821 which are coupled to rods 822, which are coupled to rotating element 812. An unlocked or disengaged configuration for the multi point locking system 810 is shown, in which the rotating element 812 is rotated to retract the rods, pulling the latches away from the tooth racks 832, and thus releasing the top upright members 831 from the bottom upright members 850. The top upright members can be pulled up or pushed down to adjust the height of the workstand support.

FIG. 8B shows side view cross sections DD' and EE' of the top view cross sections AA' and BB' in FIG. 8C. In cross section DD', the latch 821 is pulled away from the tooth rack of the top upright member 831, thus allowing the top upright member 831 to move relative to the bottom upright member 850. In cross section EE', the latch 821 is pushed toward and contact the tooth rack of the top upright member 831, thus preventing the top upright member 831 from moving relative to the bottom upright member 850.

FIG. 8C shows top view cross sections AA', BB', and CC' of the side view cross sections DD' and EE' in FIG. 8B. The cross section CC does not pass through the slit, so the bottom upright member 850 is shown having a square shape cross section area. The cross sections AA' and BB' are passing through the slit 852, and thus the bottom upright member 850 is shown having a C shape cross section area. The cross section AA' shows the latch retracted from the tooth rack. The cross section BB' shows the latch engaged with the tooth rack, with an overlapping area 824. The larger the overlapping, the higher load the workstand support can support, since the load is pushed down on the latches at the overlapped area 824.

Figure 9A:
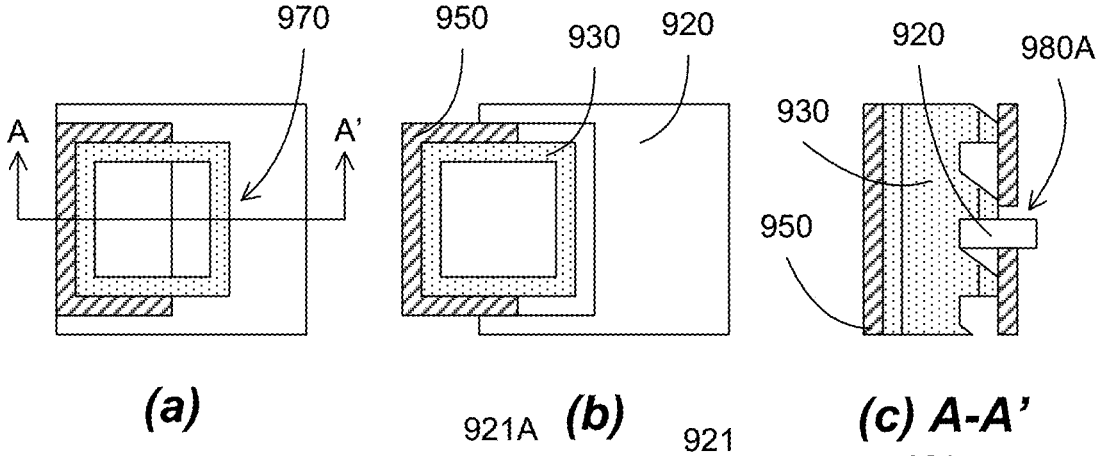
FIGS. 9A-9C illustrate configurations of a tooth rack interfacing a latch according to some embodiments.
Figure 9B:
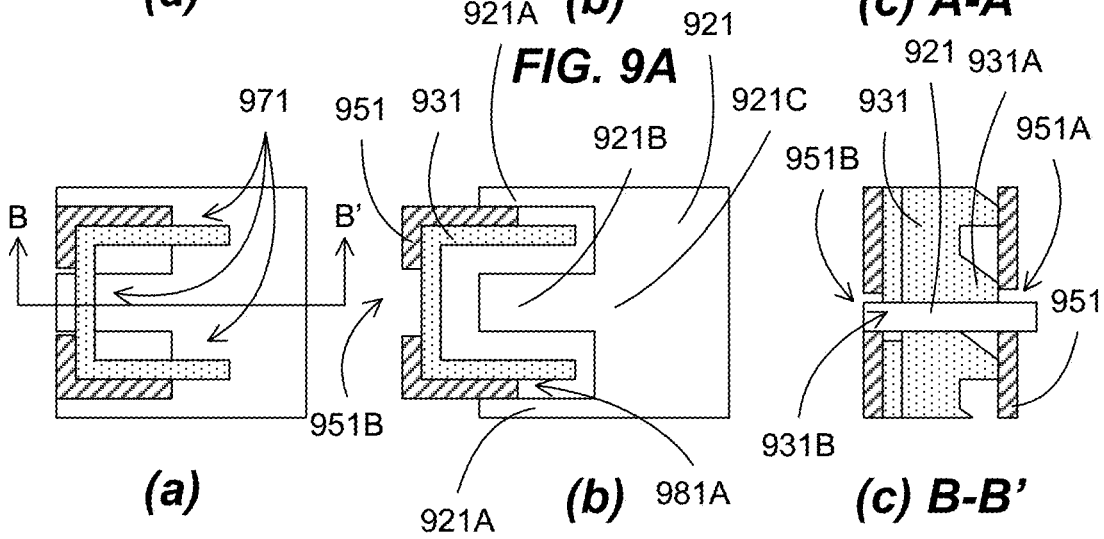
Figure 9C:
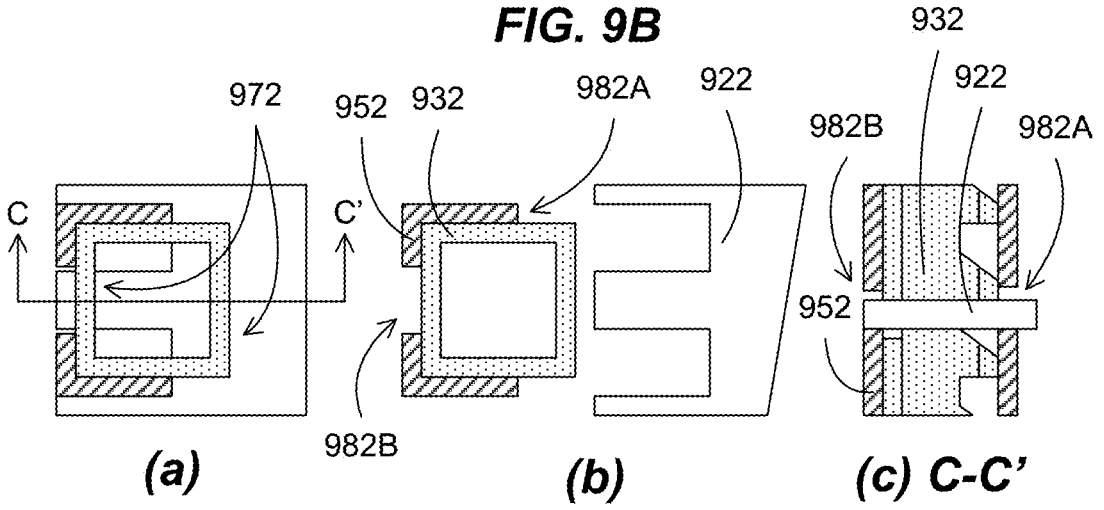

FIGS. 9A-9C illustrate configurations of a tooth rack interfacing a latch according to some embodiments. As discussed above, the load capability of the workstand support can be directly related to the overlap area of the tooth rack and the latch, e.g., to the overlap area of the top upright member at the portion of the teeth engaging with the latch. In some embodiments, the workstand support can be configured to maximize the overlap area, together with a well distribution of the overlap area.

FIGS. 9A(a)-(c) show a configuration in which the top upright member 930 has a hollow square cross section, e.g., a square tube. The tooth rack can be cut into the square tube to form teeth. Thus, the portion of the teeth resting on the latch includes the square tube portion, instead of the two extended portions in the case of a C cross section top upright member. In FIG. 9A(a), the latch 920 engages with the top upright member 930, so that a portion 970 of the square tube 930 resting on the latch 920. The cross section is through the slit, so that the cross section of the bottom upright member 950 shows a C cross section. In FIG. 9A(b), the latch 920 disengages from the top upright member 930. FIG. 9A(c) shows a cross section side view at the cut AA' of FIG. 9A(a), showing the latch 920 engaging with the teeth of the top upright member 930.

FIGS. 9B(a)-(c) show a configuration in which the top upright member 931 has a C shape cross section similar to that shown in earlier configuration, such as in FIG. 8A. The slit on the bottom upright member 951 can be cut at the front side 951A, similar to the earlier configuration. The slit can also be cut at the back side 951B, to accommodate the latch 921. The cut 951B can be offset at the top, e.g., there can be room at the top of the cut 951B between the cut 951B and the latch prong 921B, since the bottom of the latch prong 921B can rest on the bottom upright member cut 951B.

The latch 921 has two prongs 921A at the outside of the bottom upright member 951, to provide guidance in direction for the latch. The latch can also have a third prong 921B at middle, for engaging with the cut at the back side 951B. The latch can have a body portion 921C for engaging with a tooth 931A in the tooth rack.

The tooth rack can be cut into the C tube to form teeth. The top upright member can also be cut at a back side 931B, e.g., the opposite side of the tooth 931A, to form another slit 931B, for accommodating the middle prong 921B of the latch. The cut 931B can be offset at the bottom, e.g., there can be room at the bottom of the cut 931B between the cut 931B and the latch prong 921B, since the top upright member can rest on the top of the latch prong 921B.

Thus, the portion of the teeth resting on the latch includes the two extended portions and the middle portion 971, corresponded to the three prongs of the latch. In FIG. 9B(a), the latch 921 engages with the top upright member 931, so that three portions 971 of the C tube 931 resting on the latch 921. The cross section is through the slits 951A and 951B on the bottom upright member 951, so that the cross section of the bottom upright member 951 shows a C cross section with a cut in the middle. The cross section is above the tooth 931A and above the slit 931B of the top upright member 931, so that the cross section of the top upright member 931 shows a C cross section. In FIG. 9B(b), the latch 921 disengages from the top upright member 931. FIG. 9B(c) shows a cross section side view at the cut BB' of FIG. 9B(a), showing the latch 921 engaging with the teeth of the top upright member 931.

FIGS. 9C(a)-(c) show a configuration in which the top upright member 932 has a hollow square cross section similar to that shown in earlier configuration, such as in FIG. 9A. The slit on the bottom upright member 952 can be cut at the front side 952A and at the back side 952B, similar to the earlier configuration in FIG. 9B.

The latch 922 has three prongs 922A and 922C, together with a body portion 922C for engaging with a tooth 932A in the tooth rack, similar to the earlier configuration in FIG. 9B.

The tooth rack can be cut into the hollow square tube of the top upright member 932 to form teeth. The top upright member can also be cut at a back side 932B to form slit 932B, similar to the earlier configuration in FIG. 9B.

Thus, the portion of the teeth resting on the latch includes the two extended portions and the middle portion 972, corresponded to the three prongs of the latch. In FIG. 9C(a), the latch 922 engages with the top upright member 932, so that portions 972 of the hollow square tube 932 resting on the latch 922. With the hollow square tube of the top upright member 932, the portion 972 pushing on the latch 922 can be larger, e.g., due to the connecting portion of the ends of the C configuration. In FIG. 9C(b), the latch 922 disengages from the top upright member 932. FIG. 9C(c) shows a cross section side view at the cut CC' of FIG. 9C(a), showing the latch 922 engaging with the teeth of the top upright member 932.

FIGS. 10A-10C illustrate processes to form workstand supports having a multi point locking system according to some embodiments. In FIG. 10A, a workstand support can have a multi point locking system for engaging and disengaging two or more lock points between two portions of the workstand support for adjusting the height.

Operation 1000 forms a workstand support having a multi point locking system. The multi point locking system is coupled to a first portion of the workstand support. The multi point locking system can have a handle coupled to two rods disposed at two opposite ends. Each rod can be coupled to a latch configured to mate to one of multiple recesses in a second portion of the workstand support for securing the second portion to the first portion.

In FIG. 10B, a workstand support can have a multi point locking system using a handle to activate or to deactivate latches for locking and unlocking lock points between two portions of the workstand support for adjusting the height.

Operation 1020 forms a workstand support. The workstand support can have a first portion slidably coupled to a second portion. The first portion can have a multi point locking system. The multi point locking system can have two latches disposed at two opposite ends. The two latches can be coupled to a control element for activating or deactivating the latches. In the activation configuration, the latches can be configured to mate to recesses of multiple recesses in the second portion to prevent the second portion from sliding relative to the first portion. In the deactivation configuration, the latches can be configured to be released from the recesses to allow the second portion to slide relative to the first portion.

In FIG. 10C, a workstand support can have a multi point locking system together with a bias spring or actuator to automatically extend the height of the workstand support when the multiple point locking system is not engaged.

Operation 1040 forms a workstand support. The workstand support can have a first portion slidably coupled to a second portion. The workstand support can have a spring-like component configured to move the first portion away from the second portion. The first portion can have a multi point locking system to prevent the second portion from moving away from the first portion.

FIGS. 11A-11C illustrate processes to form workstand supports having a multi point locking system according to some embodiments. In FIG. 11A, a workstand support can have a multi point locking system having a latch configuration to support between 25 to 50 vol % of a first portion pushing on a second portion of the workstand support.

Operation 1100 forms a workstand support. The workstand support can have a first portion and a second portion. The first portion can have two first elements slidably coupled to two second elements of the second portion. The workstand support can have multi point locking system. The multi point locking system can have two latches configured to allow or to prevent sliding movements of the first elements relative to the second elements. A latch can be configured to secure between 25 vol % to 50 vol % at one side of a first element or a second element.

In FIG. 11B, a workstand support can have a multi point locking system having a latch configuration to support a front side and a back side of a first portion pushing on a second portion of the workstand support. The front side support can include two separate areas.

Operation 1120 forms a workstand support. Two first elements of a first portion of the workstand support can be slidably coupled to two second elements of the second portion of the workstand support. The workstand support can have two latches configured to allow or to block sliding movements of the first elements relative to the second elements. A latch can be configured to secure a front side and a back side of a first element. The front side of the first element is facing the front side of the other first element.

In FIG. 11C, a workstand support can have a multi point locking system having a latch configuration to support a front side and a back side of a first portion pushing on a second portion of the workstand support. The front side support can include one area, formed by a hollow square tube.

Operation 1140 forms a workstand support. Two first elements of the workstand support can be slidably coupled to two second elements portion of the workstand support. The workstand support can have two latches configured to allow or to block sliding movements of the first elements relative to the second elements. The first elements have a hollow interior with a surrounding material at contact areas with the latches.

In some embodiments, the present invention discloses a workstand support having a multi point locking system for securing two movable portions of the workstand support. The multi point locking system can be configured to provide a secured lock for the two portions. The multi point locking system can include secure means, such as snap locks and spring-loaded actuators, to securing the locking configuration and the unlocking configuration, to prevent accidental state transfer, such as by vibration.

The multi point locking system can include a control element, such as a handle or a push button, for activating and deactivating the multiple point lock. The control element can use rotational actions, for example, by rotating the handle, to activating and deactivating the multiple point lock. Latches can be used to engage with teeth of tooth racks for securing the two portions of the workstand support. Rod assemblies can couple the handle with the latches, so that the latches can be operated by moving the handle.

In some embodiments, the multi point locking system can be configured so that the rod assemblies form a straight line linking two opposite latches in the locking configuration. By forming a straight line, the latches can be secured to the teeth of the tooth racks, which can prevent the latches from being accidentally loosened, for example, by a vibration caused by the workpieces.

In some embodiments, the multi point locking system can include secure assemblies for securing the system to the lock or unlock configurations. The secure assemblies can include spring assemblies or actuators for biasing the latches to the teeth during the lock configuration. The secure assemblies can include snap assemblies, which can be coupled to the rod assemblies at the lock or unlock configurations for secure the latches at these configurations.

Figures 12A, 12B:
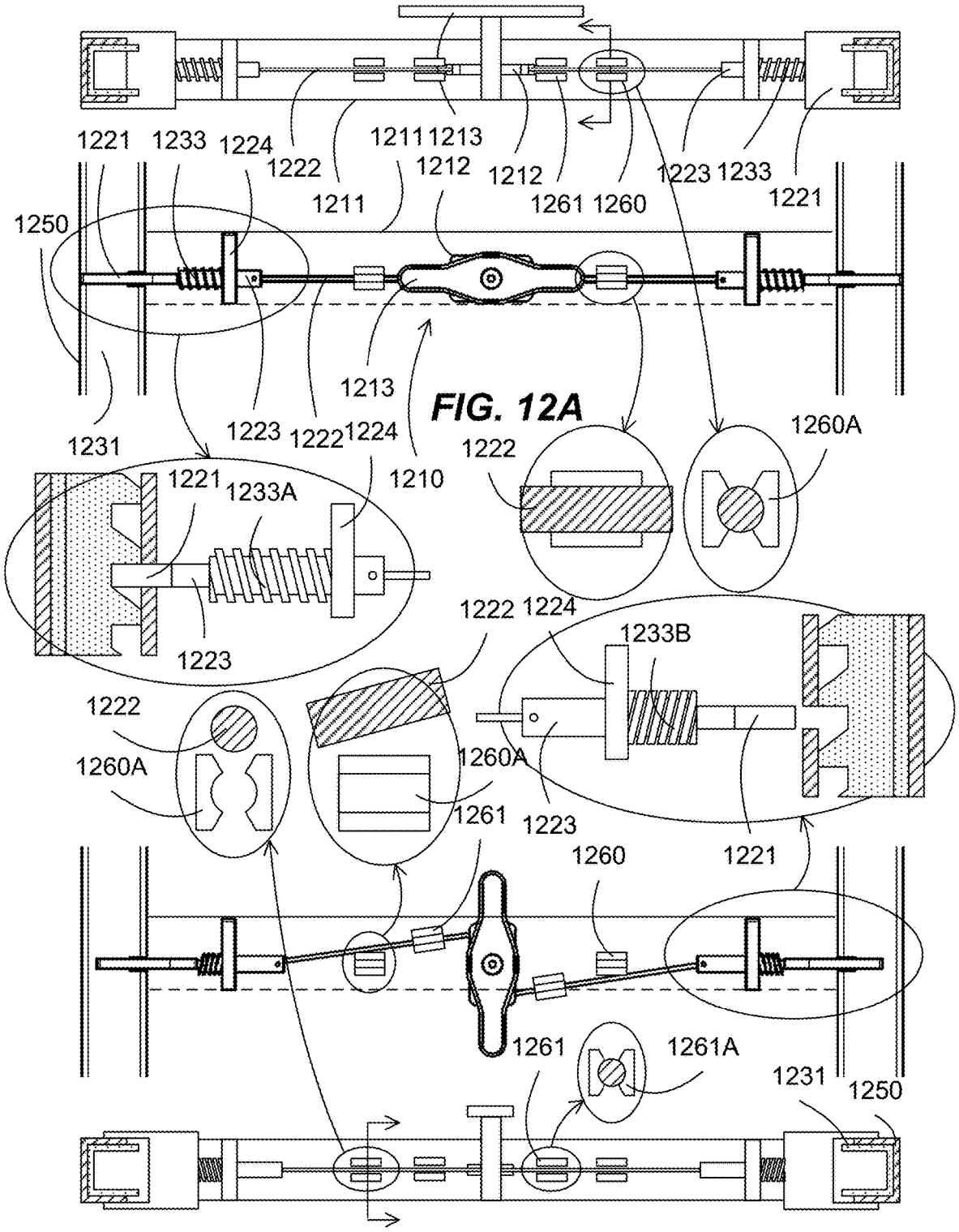
FIGS. 12A-12B illustrate a multi point locking system using rotational actions according to some embodiments.

FIGS. 12A-12B illustrate a multi point locking system using rotational actions according to some embodiments. FIG. 12A shows a lock or engaged configuration of a multi point locking system 1210. FIG. 12BA shows an unlock or disengaged configuration of a multi point locking system. The multi point locking system can include a handle 1213, coupled to a rotating element 1212. Thus, when the handle 1213 rotates, the rotating element 1212 also rotates.

The rotating element 1212 can be coupled to two rods 1222 disposed at opposite sides of the rotating element. The coupling between the rotating element and the rods can be a rotatable coupling, e.g., the rods 1222 can rotate at the coupling connection. The rods 1212 can be coupled to pins 1223, which can be fixedly coupled to latches 1221. The coupling between the rods and the pins/latches can be a rotatable coupling, e.g., the rods 1222 can rotate at the coupling connection. Guiding elements 1224 can be used to guide the movements of the pins and latches, e.g., restricting the pins to move in a direction perpendicular to the teeth of the tooth racks of the top upright members.

A connection member 1211 can be used to house the multi point locking system. The connection member can be fixed coupled to the bottom upright members 1250, e.g., each end of the connection member is fixedly coupled, such as by welding, to a bottom upright member. The connection member can have a C shape cross section, e.g., having the top side and the two sides covered, with the bottom side open. The guiding elements 1224 can be fixedly coupled, such as by welding, to the connection members.

In operation, rotating the handle can move the multi point locking system between the lock and unlock configurations, e.g., between the lock configuration shown in FIG. 12A and the unlock configuration shown in FIG. 12B. For example, a clockwise rotation of the handle can move the system from the lock to the unlock configuration. A counter clockwise rotation of the handle can move the system from the unlock to the lock configuration.

In the lock configuration, the latches 1221, the pins 1223, the rods 1222, and the rotating element 1212 are disposed n a straight line, thus the latches 1221 are pushed to the teeth of the top upright member 1231. The straight line configuration can provide a secure configuration for the latches, to prevent accidentally being loosened from the engagement positions with the teeth.

Snap latches 1260 can be used to secure the rods 1212 in the lock configuration. A snap latch 1260 can include one or two opposite cantilever 1260A having a bump that can deflect and snap in to a rod. The snap latch 1260 can be disposed on the path of the rods 1222, thus the rods 1222 can be snapped into the latch 1260 when reaching the lock configuration, to keep the rods 1222 in place. When the rods 1222 reach the cantilevers 1260A, the cantilevers can deflect to allow the rods to enter the groove formed in the cantilevers. The rods are then held in the groove, to prevent being accidentally getting out of the lock configuration.

When the handle rotates to move from the lock to the unlock configuration, the rods can be forced out of the groove of the cantilevers, and continue to move to the unlock configuration.

Snap latches 1261 can be used to secure the rods 1212 in the unlock configuration. A snap latch 1261 can include one or two opposite cantilever 1261A having a bump that can deflect and snap in to a rod. The snap latch 1261 can be disposed on the path of the rods 1222, thus the rods 1222 can be snapped into the latch 1261 when reaching the unlock configuration, to keep the rods 1222 in place. When the rods 1222 reach the cantilevers 1261A, the cantilevers can deflect to allow the rods to enter the groove formed in the cantilevers. The rods are then held in the groove, to prevent being accidentally getting out of the unlock configuration.

When the handle rotates to move from the unlock to the lock configuration, the rods can be forced out of the groove of the cantilevers, and continue to move to the lock configuration.

Spring assemblies 1233, or actuator assemblies, can be used to push the latches 1221 into the teeth of the top upright members 1231. A spring 1233 can be disposed between the latch 1221 and a fixed guiding element 1224. In the lock configuration, the spring can be in a compressed configuration 1233A, and thus can push the latch 1221 against the fixed guiding element 1224. In the unlock configuration, the spring can be further compressed 1233B. Thus, in the unlock configuration, the multi point locking system can operate by turning the handle and by releasing the handle, instead of by turning the handle in one direction and by turning the handle in an opposite direction. The spring 1233 in the further compressed state 1233B can exert a force on the handle, so that when the handle is released, or when the handle rotates slightly to get out of the snap latch 1261, the multi point locking system can automatically go to the lock configuration.

Figures 13A, 13B:
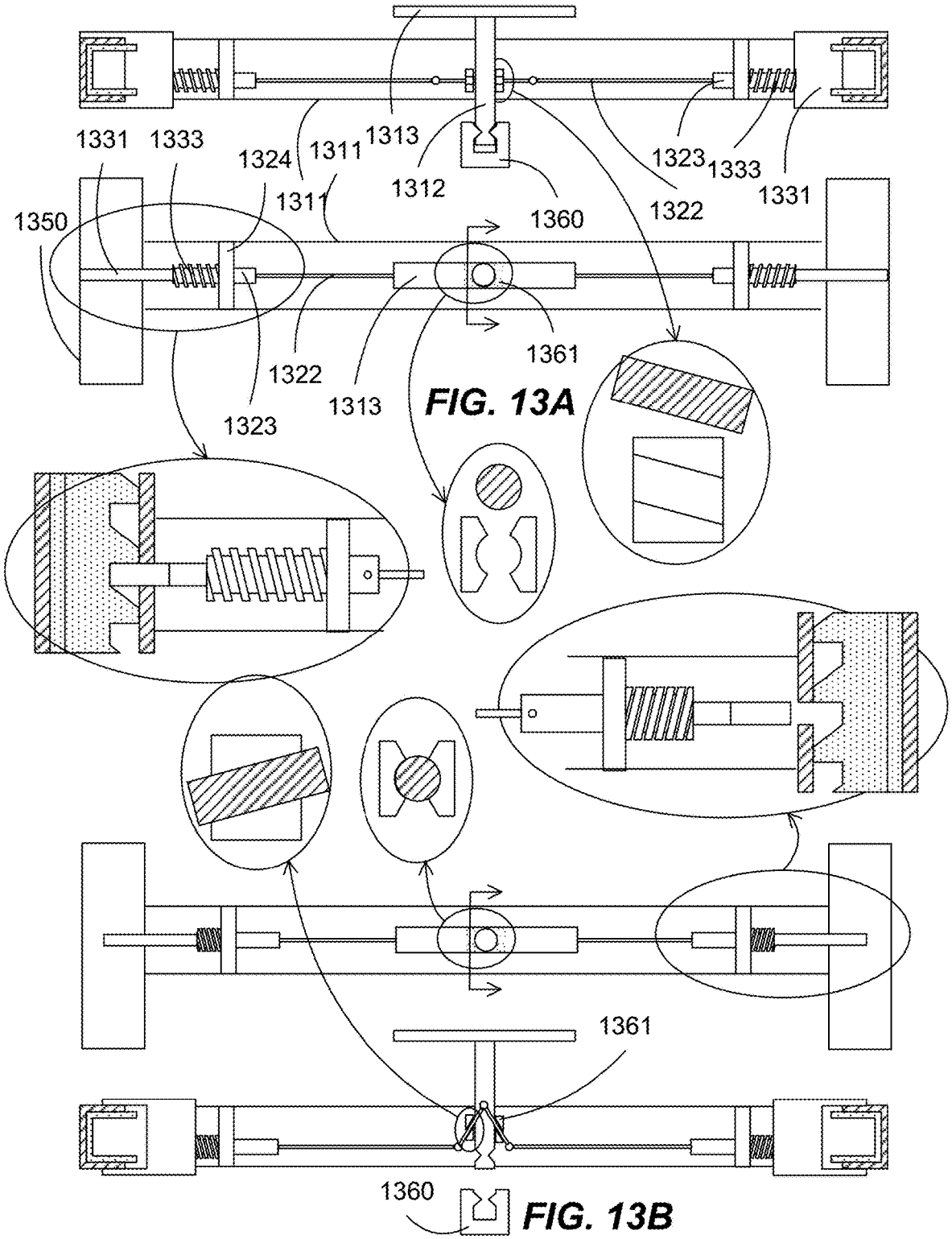
FIGS. 13A-13B illustrate a multi point locking system using pushing and pulling actions according to some embodiments.

FIGS. 13A-13B illustrate a multi point locking system using pushing and pulling actions according to some embodiments. FIG. 13A shows a lock or engaged configuration of a multi point locking system 1310. FIG. 13BA shows an unlock or disengaged configuration of a multi point locking system. The multi point locking system can include a handle 1313, coupled to a linear movement element 1312. Thus, when the handle 1313 pulls up, the linear movement element 1312 also moves up, moving the multi point locking system from the lock configuration to the unlock configuration. When the handle 1313 pushes down, the linear movement element 1312 also moves down, moving the multi point locking system from the unlock configuration to the lock configuration.

The linear movement element 1312 can be coupled to two rod assemblies 1322 disposed at opposite sides of the linear movement element. The rod assemblies can include multiple rods rotatably couple together. The rods 1312 can be coupled to pins 1323, which can be fixedly coupled to latches 1321. Guiding elements 1324 can be used to guide the movements of the pins and latches.

A connection member 1311 can be used to house the multi point locking system. The guiding elements 1324 can be fixedly coupled, such as by welding, to the connection members.

In operation, pushing and pulling the handle can move the multi point locking system between the lock and unlock configurations, e.g., between the lock configuration shown in FIG. 13A and the unlock configuration shown in FIG. 13B. For example, a pulling movement of the handle can break a straight line configuration of the rod assemblies into segmented configuration, which moves the system from the lock to the unlock configuration. A pushing movement of the handle can push the segmented configuration of the rod assemblies into the straight line configuration of the rod assemblies, which moves move the system from the unlock to the lock configuration.

In the lock configuration, the latches 1321, the pins 1323, the rods 1322, and the rotating element 1312 are disposed n a straight line, thus the latches 1321 are pushed to the teeth of the top upright member 1331. The straight line configuration can provide a secure configuration for the latches, to prevent accidentally being loosened from the engagement positions with the teeth.

Snap latches 1360 can be used to secure the rods 1312 in the lock configuration. Snap latches 1361 can be used to secure the rods 1312 in the unlock configuration. Spring assemblies 1333, or actuator assemblies, can be used to push the latches 1321 into the teeth of the top upright members 1331.

FIGS. 14A-14F illustrate workstand support having a multi point locking system according to some embodiments. In FIG. 14A, a workstand support can have a multi point locking system.

Operation 1400 forms a workstand support. The workstand support can have two first elements slidably inside two second elements. The workstand support can have multi point locking system. The multi point locking system can have two latches. The latches can be configured to be in an engaged state or a disengaged state. In the engaged state, the latches can be positioned in recesses in the first elements and slits in the second elements to prevent sliding movements of the first elements relative to the second elements. In the disengaged state, the latches can be withdrawn from the recesses to allow sliding movements of the first elements relative to the second elements.

In FIG. 14B, a workstand support can have a multi point locking system. The multi point locking system can have a rotating element or a linear movement element to rotate or move rod assemblies for lock and unlocking the multi point locking system.

In operation 1420, the latches can be coupled to two rod assemblies. The rod assemblies can be coupled to a rotatable element. When the rotatable element rotates, the rod assemblies extend or retract to move the latches between engaged and disengaged states.

In operation 1421, the latches can be coupled to two rod assemblies. The rod assemblies can be coupled to a linear movement element. When the linear movement element moves, the rod assemblies extend or retract to move the latches between engaged and disengaged states.

In FIG. 14C, a workstand support can have a multi point locking system. The multi point locking system can form a straight line for locking the multi point locking system into the locking configuration.

In operation 1430, in the engaged state, the rod assemblies form a straight line for locking the latches from accidently being released.

In FIG. 14D, a workstand support can have a multi point locking system. The multi point locking system can include a linear guide to guide the pins in rod assemblies.

In operation 1440, each latch is coupled to a rod assembly. The workstand support can have linear guides. Each linear guide is configured to guide a rod of the rod assembly so that the rod moves in desired directions between engaged and disengaged states.

In FIG. 14D, a workstand support can have a multi point locking system. The multi point locking system can include a spring to bias the latches into the locked or engaged configuration.

In operation 1450, each latch is coupled to a rod assembly. The rod assembly is coupled to a spring. The spring is configured to bias the latch to the engaged state.

In FIG. 14D, a workstand support can have a multi point locking system. The multi point locking system can include snap mechanisms to secure the multi point locking system into the locked or unlocked configuration.

In operation 1460, each latch is coupled to a rod assembly. The rod assembly is coupled to a first snap mechanism. The first snap mechanism is configured to secure the latch to the engaged state. The rod assembly can be coupled to a second snap mechanism. The second snap mechanism is configured to secure the latch to the disengaged state.

In some embodiments, the present invention discloses a workstand support having a foldable configuration for reducing storage space. The workstand support can be folded into a plane or into a column configuration, through an arrangement of hinges.

Figure 15A:
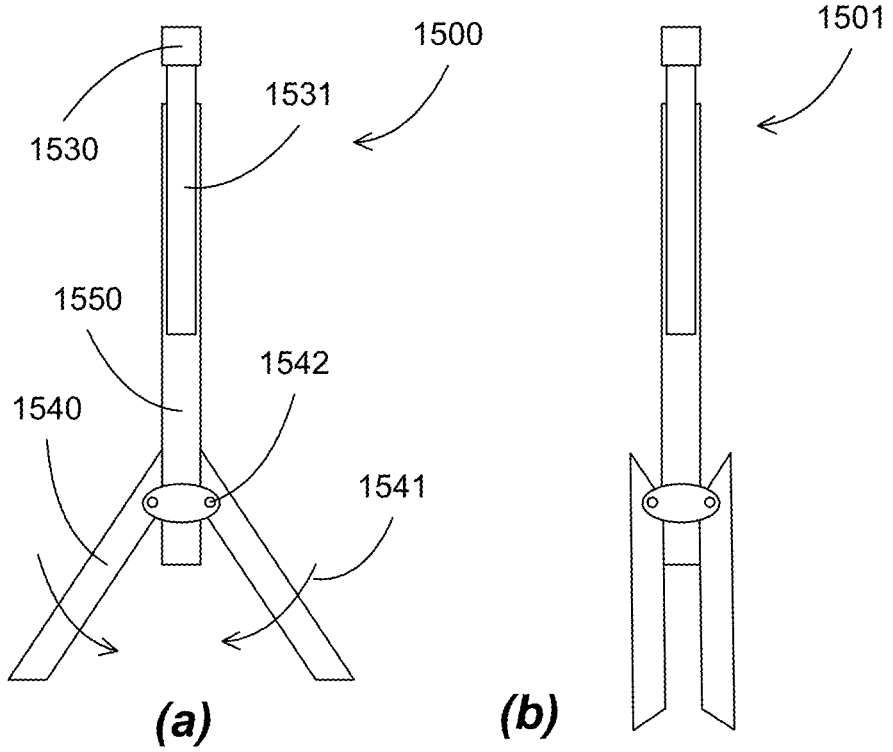
FIGS. 15A-15B illustrate foldable configurations of a workstand support according to some embodiments.
Figure 15B:
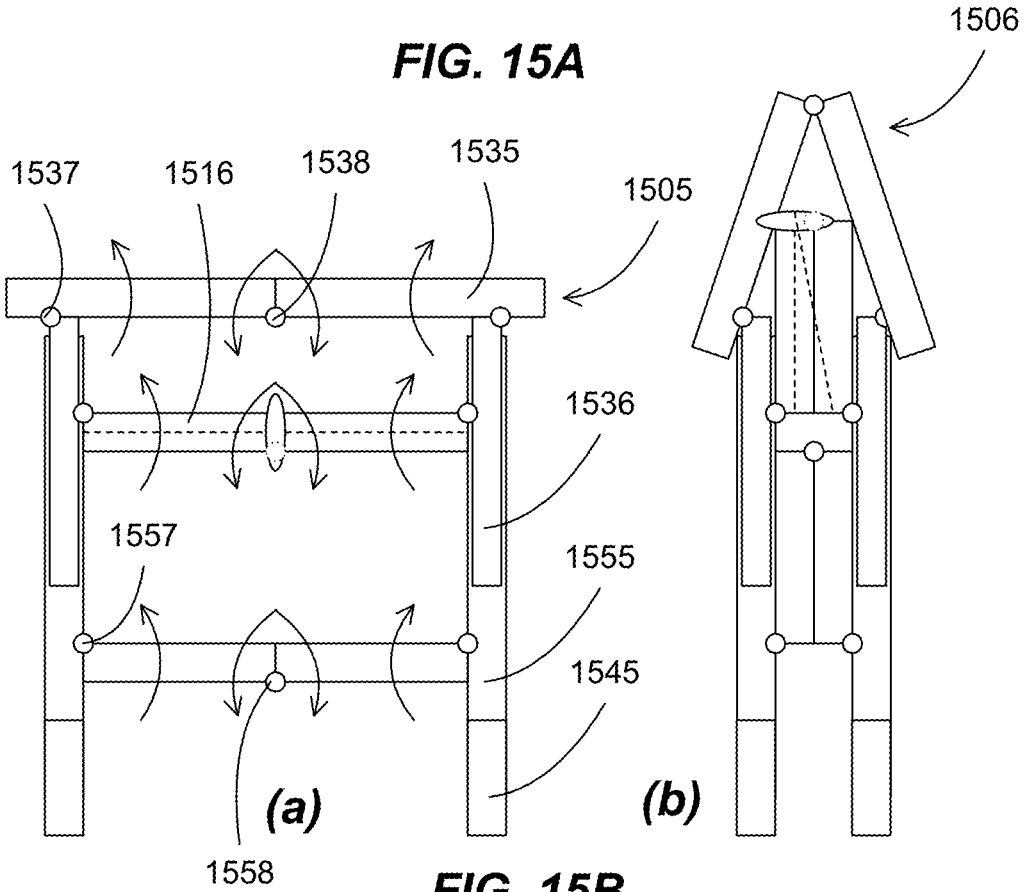

FIGS. 15A-15B illustrate foldable configurations of a workstand support according to some embodiments. FIGS. 15A(a)-15A(b) shows a foldable configuration 1501 for a workstand support 1500. The foldable configuration 1501 can fold the workstand support to be in parallel planes, e.g., a flat plane of the main portion of the workstand support and the legs of the workstand support folded parallel to the flat plane. A workstand support 1500 can include a top portion having top upright members 1531 connected to a horizontal connection member 1530. The top upright members and the horizontal connection member can be configured to form a plane, e.g., the top upright members and the horizontal connection member are disposed in a flat plane.

The workstand support 1500 can also include a bottom portion having bottom upright members 1550 connected to connection members and a multi point locking system. The bottom upright members, the connection members, and the multi point locking system can be configured to form a plane, e.g., the members and the multi point locking system are disposed in a same flat plane as the top portion. The bottom portion can include multiple legs 1540, extended from the bottom upright members, to provide stability for the workstand support in the operating configuration.

In the storage configuration, the legs 1540 can be folded to be parallel to the bottom upright members, e.g., the legs can be disposed parallel to the flat plane formed by the top portion and the bottom portion without the extended legs.

Two plates 1542 can be fixed coupled to the bottom upright members 1550, for example, by welding. Two pins on two sides of the plates 1542 can pass through the legs 1540 at proper locations, to allow the legs 1540 to be folded 1541 to a position parallel to the bottom upright members 1550.

FIGS. 15B(a)-15B(b) shows a foldable configuration 1506 for a workstand support 1505. The foldable configuration 1506 can fold the workstand support to form a column, e.g., all members of the workstand support are placed next to each other to form a bundle of members.

A workstand support 1505 can include a top portion having top upright members 1536 connected to a horizontal connection member 1535. The workstand support 1505 can also include a bottom portion having bottom upright members 1555 connected to connection members and a multi point locking system disposed in a connection member 1516. The bottom portion can include multiple legs 1545, extended from the bottom upright members, to provide stability for the workstand support in the operating configuration. The legs 1545 can be folded to be parallel to the bottom upright members 1555, similar to the folded configuration above.

The top portion can include hinges 1537 and 1538. The hinge 1538 can allow the horizontal member 1535 to be folded in half. The hinges 1537 can allow the folded horizontal member 1535 to be folded at hinges 1537 to be substantially parallel to the top upright members 1536.

The bottom portion can include hinges 1557 and 1558. The hinges 1558 can allow the connection members, including the connection member 1516 that houses the multi point locking system, to be folded in half. The hinges 1557 can allow the folded connection members to be folded at hinges 1557 to be substantially parallel to the bottom upright members 1555.

The workstand support 1505, after being folded, can form a bundle 1506 for storage.

Figure 16:
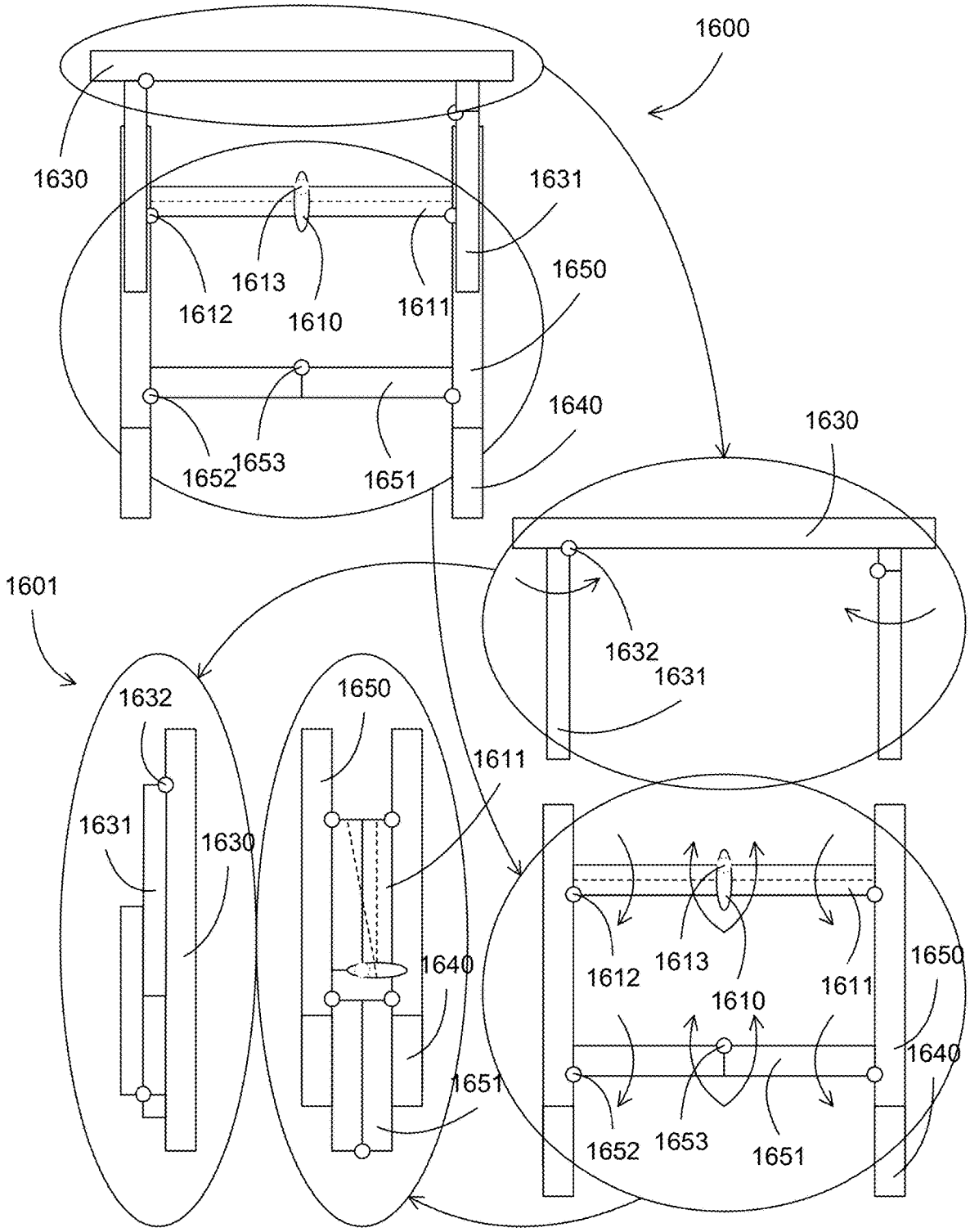
FIG. 16 illustrates a foldable configuration of a workstand support according to some embodiments.

FIG. 16 illustrates a foldable configuration of a workstand support according to some embodiments. A workstand support 1600 can be folded to form two bundles 1601, which can occupy less space for storage.

A top portion can be removed from a bottom portion of the workstand support. The top and bottom portions can be folded separately, to form two bundles for storage. The top portion can have hinges 1632, which are disposed at or near the connection between the top upright members 1631 and the horizontal member 1630. The top upright members 1631 can be folded using the hinges 1632, to form a bundle in which the top upright members 1631 are disposed in parallel with the horizontal member 1630.

The bottom portion can have hinges 1652 and 1653 for folding the connection member 1651 to be parallel with the bottom upright members 1650. The bottom portion can have hinges 1612 and 1613 for folding the connection member 1611, which houses the multi point locking system 1610, to be parallel with the bottom upright members 1650. The bottom portion can be folded to form a bundle in which the connection members are folded in half and then folded in parallel with the bottom upright members.

FIGS. 17A-17D illustrate a process for folding a workstand support according to some embodiments. A workstand support 1700 can have legs 1740 coupled to bottom upright members 1750 through hinges 1742. Hinges 1742 are configured to allow the legs 1740 to rotate to a position parallel to the bottom upright members 1750, for example, by using an pivotal axis at the legs closer to one side and nearer the obtuse angle, e.g., farther from acute angle.

The workstand support 1700 can include a top portion having top upright members 1731 coupled to a horizontal member 1730. The top portion is configured to form a flat plane. The workstand support 1700 can include a bottom portion having bottom upright members 1750 coupled to connection members 1711 and 1751. The top upright members are disposed in the bottom upright members, so that the top and bottom upright members can move relative to each other. A multi point locking system 1710 is coupled to a connection member, such as to member 1711 for locking the top portion to the bottom portion. Legs 1740 can be coupled to the bottom upright members 1750, through hinges 1742, so that the legs can be extended from the bottom upright members of can be folded parallel to the bottom upright members. The members of the bottom portion are configured to form a flat plane, and when the top and bottom upright members are coupled together, the top and bottom portion form a same flat plane with the legs rotatable in and out of the flat plane.

Figure 17A:
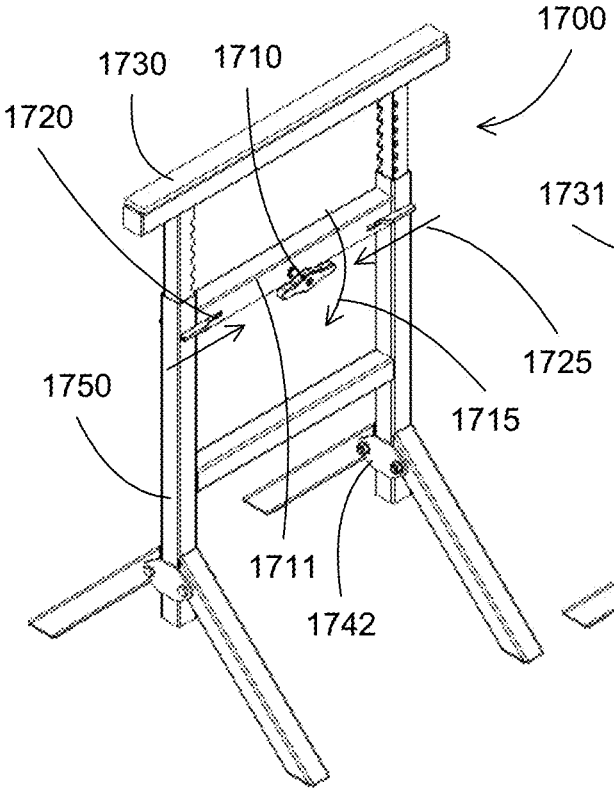
FIGS. 17A-17D illustrate a process for folding a workstand support according to some embodiments.

To prepare a workstand support for storage, the top portion can be pushed down to be as close as possible to the bottom portion, and the legs folded. FIG. 17A shows a workstand support 1700 in an operating state, with the legs extended to provide stability, and the top portion lifted up to a desired height. The multi point locking system 1710 is first rotated to unlock the top portion from the bottom portion. When the handle to the multi point locking system 1710 rotates 1715, the latches retract 1725, and the top upright members 1731 can move freely relative to the bottom upright members 1750.

Figure 17B:
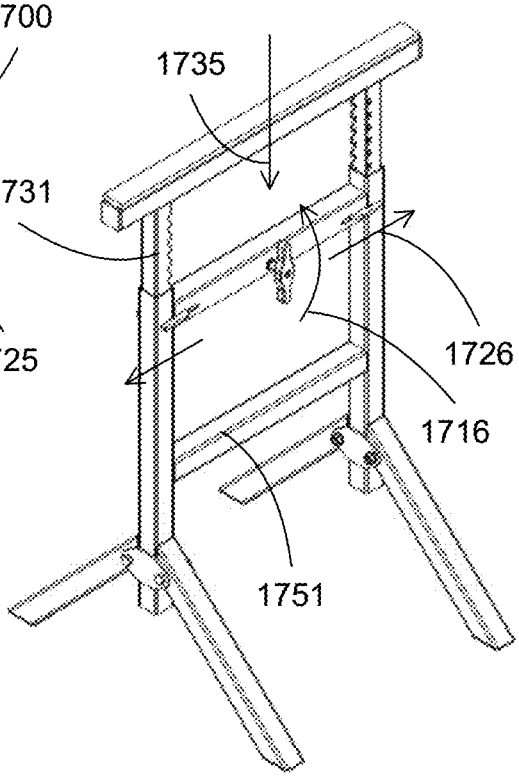

In FIG. 17B, with the top portion unlocked from the bottom portion, the top portion can be pushed down 1735 to be close to the bottom portion. Afterward, the handle rotates in an opposite direction 1716 to extend 1726 the latches, and the top upright members 1731 are now locked with the bottom upright members 1750.

Figure 17C:
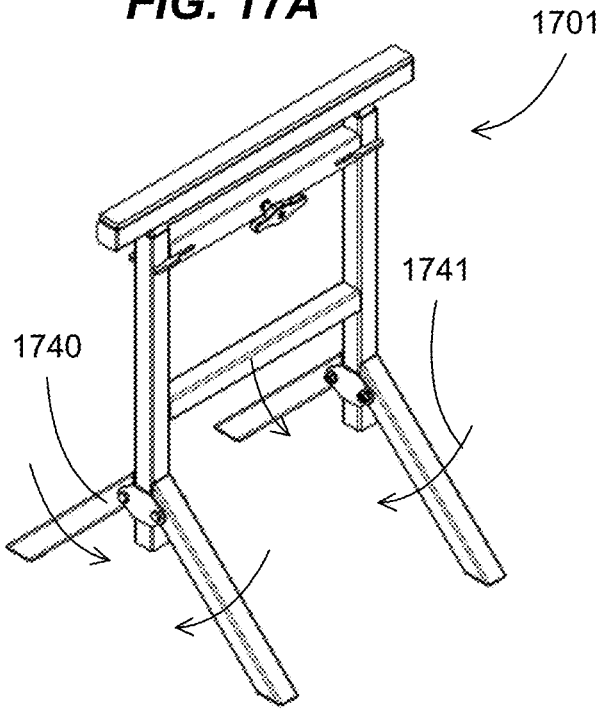
Figure 17D:
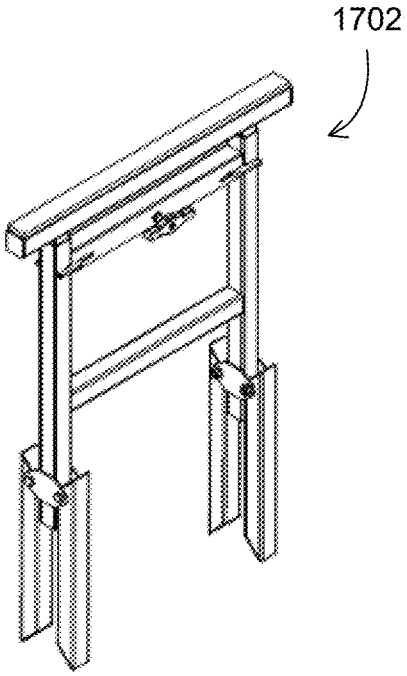

In FIG. 17C, the legs 1740 are folded to be parallel to the flat plane formed by the top portion and the members of the bottom portion. FIG. 17D shows a folded configuration 1701 of the workstand support 1700, ready for storage. The folded configuration 1701 can occupy a lot less space as compared to the operating configuration of the workstand support 1700.

FIGS. 18A-18C illustrate processes to form foldable workstand supports according to some embodiments. FIG. 18A shows a workstand support configuration with foldable legs for storage.

Operation 1800 forms a workstand support. The workstand support can have a first portion and a second portion. The first portion can have two first elements connected through a second element in a plane. The second portion can have two third elements connected through a fourth element in a plane. The first elements can be slidably coupled to the third elements. The workstand support can have multi point locking system. The multi point locking system can have two latches configured to allow or to prevent sliding movements of the first elements relative to the second elements. The second portion can have two legs foldably extended from the third elements.

FIG. 18B shows a workstand support configuration with foldable legs and body for storage. In operation 1820, a first element of the first elements can have a hinge coupling the first element to the second element. The hinge can allow the first element to be folded parallel to the second element. The second element can have a hinge to allow the second element to be folded. A third element of the third elements can have a hinge coupling the third element to the fourth element. The hinge can allow the third element to be folded parallel to the fourth element. The fourth element can have a hinge to allow the fourth element to be folded.

FIG. 18C shows a workstand support configuration with separate folded portions for storage. In operation 1840, a first element of the first elements can have a hinge coupling the first element to the second element. The hinge can allow the first element to be folded parallel to the second element. A third element of the third elements can have a hinge coupling the third element to the fourth element. The hinge can allow the third element to be folded parallel to the fourth element. The fourth element can have a hinge to allow the fourth element to be folded.

In some embodiments, the present invention discloses a workstand support having a continuous height adjustment and a discrete height adjustment. The workstand support can have a top portion slidably coupled to a bottom portion. The top portion can have tooth racks with multiple teeth, to be mated to latches from the bottom portion. The tooth racks can allow discrete adjustments, the height of the workstand support can be adjusted at discrete levels corresponded to the teeth on the tooth racks. For example, if the separation of two teeth in the tooth racks is 25 mm, the height of the workstand support can be adjusted at an increment of 25 mm.

In some embodiments, the workstand support can have a continuous height adjustment, for example, through a turnbuckle coupled between the horizontal members and the top upright members. By rotating the turnbuckle, the horizontal member can move continuously toward or away from the top upright members, resulting in a continuous adjustment of the height of the workstand support.

Figure 19A:
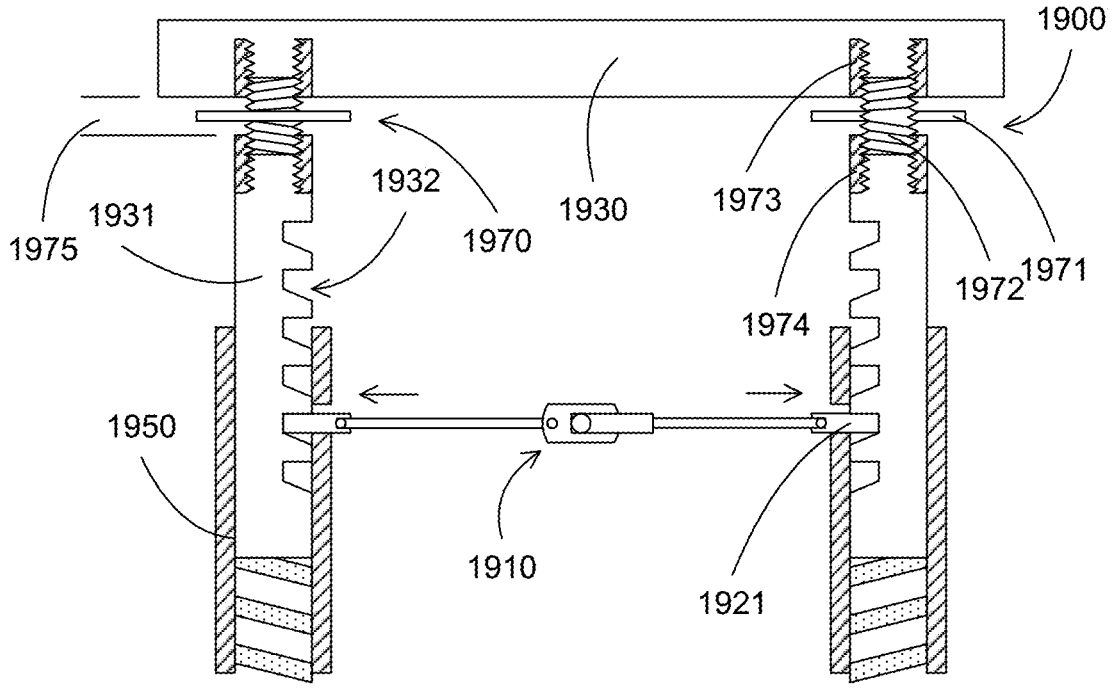
FIGS. 19A-19B illustrate a workstand support having continuous and discrete height adjustments according to some embodiments.
Figure 19B:
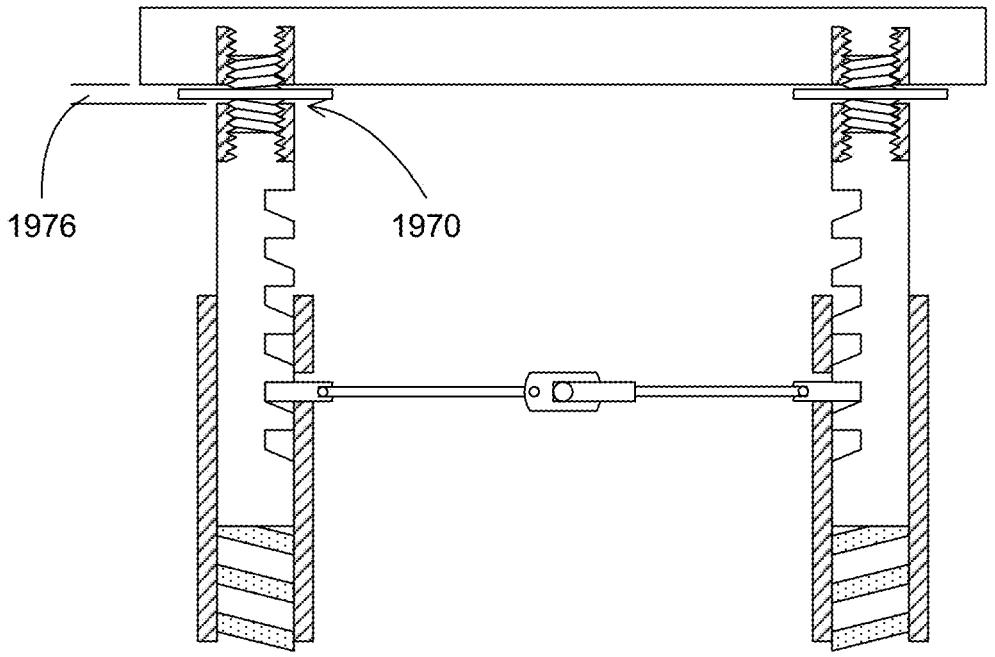

FIGS. 19A-19B illustrate a workstand support having continuous and discrete height adjustments according to some embodiments. A workstand support 1900 can have a top portion coupled to a bottom portion through tooth racks 1932 disposed on the top upright members 1931. A multi point locking system 1910 having latches 1921 can be used to lock the movements of the top upright members 1931, for example, by the latches 1921 engaging with the teeth on the tooth racks 1932. The latches can engage with different teeth, e.g., the height of the workstand support can be adjusted discretely by changing the teeth locations at which the latches are engaged to.

The workstand support can include a continuous height adjustment mechanism, such as a turnbuckle assembly 1970. The turnbuckle assembly 1970 can include two threaded nuts 1973 and 1974, with a threaded nut 1973 coupled to the horizontal member 1930 and a threaded nut 1974 coupled to a top upright member 1931. The threaded nuts can have opposite thread, e.g., one having a left hand thread and one having a right hand thread. The turnbuckle assembly 1970 can include a threaded bolt 1972 having opposite thread at different ends. A handle 1971 can be coupled to the threaded bolt 1972 for ease of turning the threaded bolt. By turning the handle, the threaded bolt can go in or out of the nuts, and can change a distance between the horizontal member and the top upright members. For example, FIG. 19A shows a position of the threaded bolt 1972 with the nuts 1973 and 1974, providing a separation distance 1975. FIG. 19B shows a new position of the threaded bolt 1972 with the nuts 1973 and 1974, after the handle turning to drive the bolt deeper into the nuts, providing a smaller separation distance 1976.

Other continuous height adjustment mechanisms can be used.

FIGS. 20A-20C illustrate processes to for height adjustment according to some embodiments. FIG. 20A shows a process to adjust a height of a workstand support. Operation 2000 forms a workstand support. The workstand support can have two first portions slidably coupled to two second portions. The workstand support can have a first moving mechanism having a multi point locking system. The first mechanism can be configured to secure the first portions to the second portions at discrete locations. The workstand support can have a second moving mechanism having a rotational-to-linear conversion. The second mechanism can be configured to secure the first portions to the second portions at continuous locations.

FIG. 20B shows a process to adjust a height of a workstand support. Operation 2000 forms a workstand support. The workstand support can have two first portions slidably coupled to two second portions. Each of the first portions can have multiple discrete recesses. The workstand support can have a multi point locking system coupled to the second portions. The multi point locking system can have two latches configured to mate with two of the multiple discrete recesses of the two first portions to prevent sliding movements of the first portions relative to the second portions. The workstand support can have two rotational-to-linear coupling. The rotational-to-linear coupling can be coupled to the first portions and the second portions. The rotational-to-linear coupling can be configured to move the first portion relative to the second portion continuously between two discrete recess positions.

FIG. 20C shows a process to adjust a height of a workstand support. Operation 2040 adjusts a height of a workstand support discretely, followed by continuously.

FIGS. 21A-21C illustrate a configuration for a locking mechanism between the top upright members and the bottom upright members according to some embodiments. In FIG. 21A, the top upright member 2131 can have a tooth rack having multiple teeth 2133 and multiple recesses 2132. The recess 2132 can have two portions 2132A and 2132B. The first portion 2132A can be a flat portion, which is configured to be mated with a latch 2121, e.g., the recess portion 2132A can have the shape of the latch 2121. The first portion 2132A can have a flat surface 2132C, which can be disposed perpendicular to the sliding direction 2172 of the top upright member 2131 relative to the bottom upright member 2150.

The second portion 2132B can be a tapered portion, which can be configured so that a force 2172 pushing on the top upright member to move away from the bottom upright member can be decomposed to a force 2173 pushing the latch 2121 away from the recess 2132.

FIG. 21B shows a configuration 2170 in which the latch 2121 is mated to the first flat portion 2132A, for example, by a rod assembly of the multi-point locking mechanism pushing the latch toward the top and bottom upright members. Since the latch is mated to the first flat portion of the recess at a flat surface perpendicular to the force pushing on the top upright member, there is no force component to push the latch away, leading to the top upright member being secured to the bottom upright member.

FIGS. 21C(a)-21C(d) show a process for regulating the movements of the top upright member, based on the tapered portion 2132B of the recess 2132. In FIG. 21C(a), the latch 2121 can be released 2171A from the first flat portion 2132A of the recess 2132. In FIG. 21C(b), the latch is further withdrawn 2171B, and the spring 2151 can push the top upright member 2131 upward. In FIG. 21C(c), the latch is withdrawn to a maximum position 2171C, and the spring 2151 can push the top upright member 2131 further upward. In FIG. 21C(d), the latch is snapped back to the first flat portion of the next recess.

In some embodiments, the tapered portion 2132B of the recess 2132 is configured to provide a regulation of the movements of the top upright members. A spring 2151 can be disposed under the top upright member, and can be biased to push on the top upright member. When the latch is at the first flat portion 2132A of the recess, the top upright member is prevented from being moved, even with the force from the spring. When the latch is withdrawn from the first flat portion, the spring force 2172 can have a force component 2173 that pushes the latch further away. Thus, an operator can exert a force 2174 on the latch, for example, by holding on the handle of the multi-point locking system, to regulate the force component 2173 to regulate the movements of the top upright member away from the bottom upright member.

For example, if the operator exerts a strong force 2174 that is equal or higher than the force component 2173 caused by the spring force 2172, the top upright member does not move, e.g., the top upright member stays at the current location.

If the operator relaxes the force 2174 on the latch, so that the force 2174 is slightly less than the force component 2173, the top upright member can slowly move upward. The less force 2174 that the operator exerts on the latch, the higher the force acting on the top upright member to push the top upright member faster upward.

The operator can loosely hold the handle, so that the latch can snap back to the first flat portion of the next recess, effectively allowing the top upright member to move upward only one tooth. If the operator holds firmly on the handle, the latch can remain withdrawn, and the top upright member can continue to move upward.

Figure 22A:
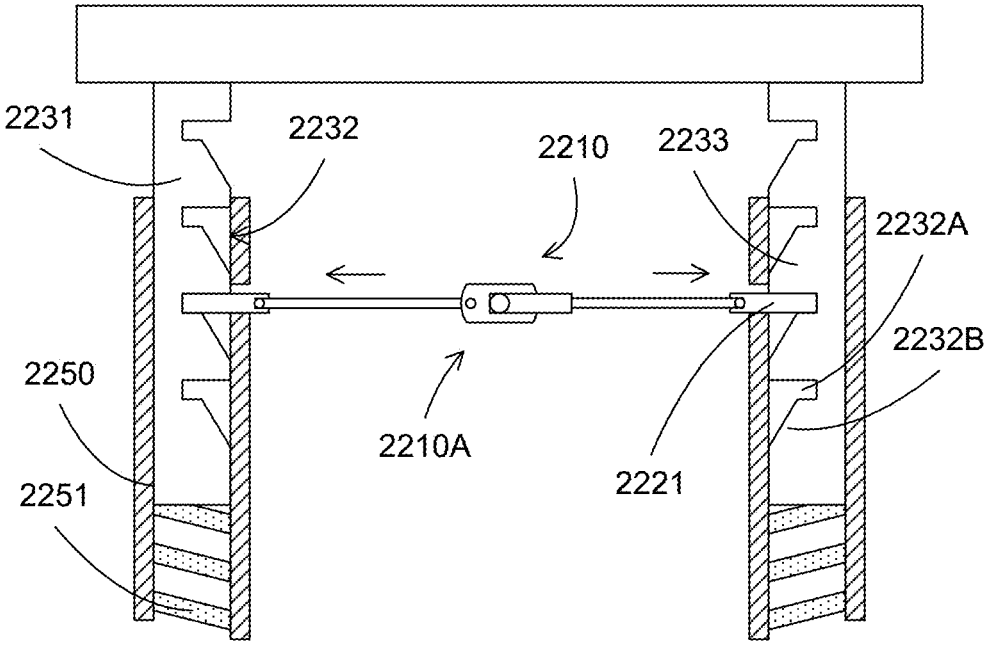
FIGS. 22A-22B illustrate operations of a multi point locking system in a workstand support according to some embodiments.
Figure 22B:
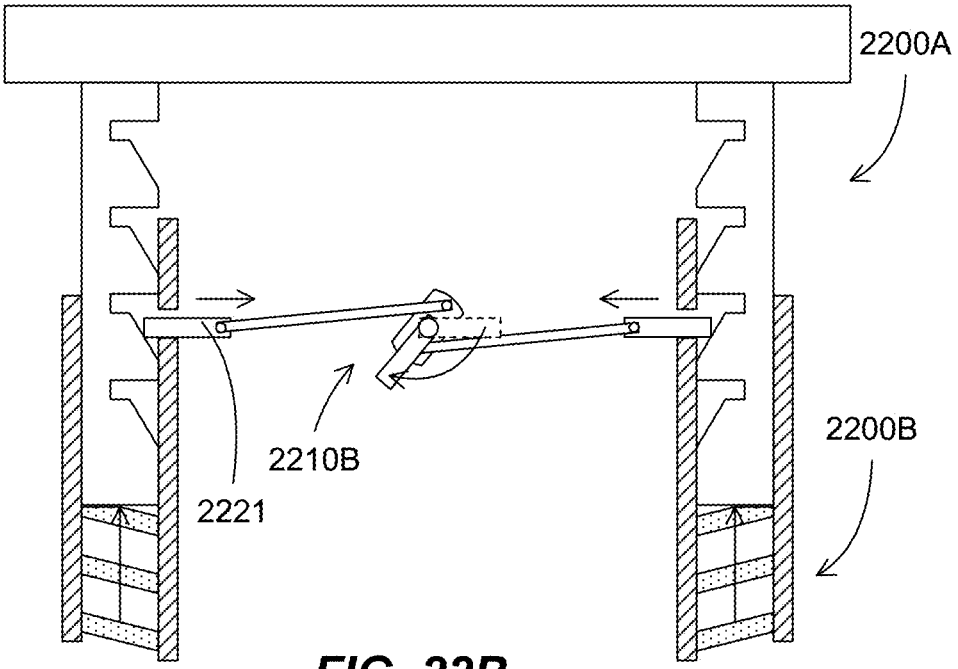

FIGS. 22A-22B illustrate operations of a multi point locking system in a workstand support according to some embodiments. FIG. 22A shows a locked or engaged state of the multi point locking system 2210, in which the height of a workstand support 2200 is fixed. FIG. 22B shows an unlocked or disengaged state of the multi point locking system 2210, in which the height of the workstand support 2200 can be adjusted.

The workstand support 2200 can include a top portion 2200A, which is movably coupled to a bottom portion 2200B. The top portion 2200A can include two top upright members 2231, which are movably coupled to the bottom upright members 2250 of the bottom portion 2200B.

The workstand support can have multiple locking positions, which can be accomplished by the top upright members having multiple lockable positions. For example, the top upright members 2231 can have a tooth rack 2232 having multiple teeth 2233 and multiple recesses 2232. The teeth 2233 can have a flat bottom surface, for mating with a top surface of latch 2221. The teeth 2233 can have a tilted top surface, to regulate the movements of the top upright members away from the bottom upright members. The recesses can have a deep recess portion 2232A configured to mate with the latch 2221. The recesses can have a tapered portion 2232B, which can form the tilted top surface of the teeth 2233, and is configured to control the force pushing the top upright members upward due to the springs 2251.

The bottom upright members 2250 can be configured to accept the top upright members 2231. A spring 2251 or an actuator assembly can be coupled to the top upright members. The spring 2251 can be configured to bias the top upright member upward, e.g., the spring can be in a compressed state to push the top upright member upward. Thus, without any constraint, the top upright members can move upward.

The workstand support can have a multi point locking system 2210, which can include a handle coupled to a rotating element. Rods can be coupled to the rotating element at one end. The other ends of the rods can be coupled to the latches 2221.

In the locked or engaged state 2210A, the latches 2221, the rods, and the rotating element 2212 form a straight line, with the latches engaging with the top portion 2232A of the recesses of the top upright members 2231. In the locked state, the top upright members are secured to the bottom upright members, forming a workstand support with a desired height.

The handle can be rotated, for example, by a worker attempting to adjust the height of the workstand support. When the handle rotates, the rotating element also rotates, which can pull the rods and the latches 2221 away from the recesses, e.g., from the top portions of the recesses. The handle can rotate to an angle that can pull the latches away from the top portion, so that the latches contact the tapered portion of the recesses (or the tilted top surface of the teeth). The rotation of the handle can provide a control on the movements of the top upright members, e.g., the more the angles of the rotation, the more force acting on the top upright members to move the top upright members upward. The handle can be released so that the latches can engage with the top portion of the next recesses.

In some embodiments, the present invention discloses a workstand for supporting workpieces. For example, a flat panel can be disposed on two workstands to form a work surface, on which the workpieces can be placed. The workstand can include a top portion movably and securably coupled to a bottom portion. The movement of the top portion relative to the bottom portion is configured to adjust a height of the workstand, e.g., raising or lowering the work surface. The top portion can be secured to the bottom portion to fix the height of the workstand, e.g., to provide a stable and secured work surface.

The top portion can include a top beam coupled to two top leg portions. The top leg portions can be disposed in parallel, to allow the top portion to slide along the direction of the top leg portions. The top leg portions can be fixedly coupled to the top beam.

The bottom portion can include two bottom leg portions. The bottom portion can include a support beam coupled to the bottom leg portions for stabilizing the bottom leg portions. The bottom leg portions can be disposed in parallel, to allow the top leg portions to slide along the direction of the bottom leg portions. The bottom leg portions can be configured to be linear guides for the top leg portions, e.g., each top leg portion can be configured to be able to slide inside or outside a bottom leg portion. In the following description, the top leg portions can be configured to slide inside the bottom leg portions. However, the invention is not so restricted, and variations are provided in the case that the top leg portions are configured to slide outside the bottom leg portions.

Each bottom leg portion can include one or more legs, to stabilize the bottom leg portion. The legs can be coupled to the bottom leg portion through hinges, which are configured to allow the legs to be folded to be parallel to the bottom leg portion.

The bottom portion can include a multi-point locking system, which can be configured to simultaneously secure the two top leg portions to the two bottom leg portions. The multi-locking system can be housed in a hollow beam connecting the two bottom leg portions. When the multi-point locking system is engaged, each of the two top leg portions is secured to a corresponding bottom leg portion of the two bottom leg portion. When the multi-point locking system is disengaged, the top leg portions are freely to move relative to the bottom leg portion.

In some embodiments, the multi-point locking system can include a handle. The handle can be configured so that, when turning, can toggle two latch elements between an engaged (or secure) status and a disengaged (or release) status for the two top leg portions relative to the two bottom leg portions. For example, the handle, in a secure position, can extend the latch elements into slits in the bottom leg portions into recesses in the top leg portions to secure the top leg portions to the bottom leg portions. A snap mechanism can be included to secure the multi-point locking system in the engaged status. The snap mechanism can include a bendable component, which can be bent to accept the multi-point locking system before returning to the unbent position. When the handle is turned, the latch elements can be retracted, e.g., to move to the disengaged status, to withdraw the latch element out of at least the recesses in the top leg portions, which can allow the top leg portion to move relative to the bottom leg portion. Another snap mechanism can be included to secure the multi-point locking system in the disengaged status.

The handle can be coupled to two rod assemblies disposed in opposite directions, for example, each rod assembly toward a bottom leg portion. Each rod assembly can include a latch element, which is configured to mate with a recess of multiple recesses in a top leg portion for securing the top leg portion to a bottom leg portion. The handle can be configured to rotate the rod assemblies, or moving the latch elements coupled to the rod assemblies between an engaged status and a disengaged status for the two top leg portions relative to the two bottom leg portions. In the engaged state, the two rod assemblies can form a straight line to prevent from accidental being released from the engaged state.

Further, in the engaged state, the rod assemblies can be snapped into a secure or latched or locked position to prevent from being accidental released from the engaged state. For example, a snap mechanism having a flexible opening leading to a secure position can be disposed at the engaged position of the rod assemblies. To enter the engaged state, the rod assemblies can enter the opening, pushing open the flexible opening to be at the secure position. Alternatively, the snap mechanism can include a differential entry to the secure position, e.g., an easy way to enter but more difficult to leave the secure position. The rod assemblies thus can easily enter the secure position, but leaving the secure position would not be easy, for example, not due to vibration or accident. The snap mechanism thus can guard against accidental movements.

Also, in the disengaged state, the rod assemblies can be snapped into a secure or latched or locked position to prevent from being accidental released from the disengaged state.

In some embodiments, each latch element can be coupled to a linear guide configured to move the latch in a desired direction between an engaged state and in a disengaged state of the top leg portions with the bottom leg portions. The latch element can be coupled to a spring, which is configured to bias the latch element into the engaged state. The spring can provide a safety cushion for the engaged state, meaning when the latch element is slightly withdrawn or released, for example, by a vibration or by an accident movement, the spring can still set the latch element at the engaged state. Only when the latch element is purposely withdrawn or released, then the latch element can be put in the disengaged state.

In some embodiments, the latch elements can be coupled to a control or regulating element to control or to regulate a movement of the top leg portions relative to the bottom leg portions. For example, the latch elements can be coupled to a handle, and by exerting rotational forces on the handle, the movements of the top leg portions due to a pushing spring can be controlled or regulated. For example, a spring-like component can be disposed under each top leg portion and configured to push the top leg portion away from the bottom leg portion.

In some embodiments, a latch element is configured to mate with a recess of multiple recesses in a top leg portion. The recess can include a flat portion and a tapered portion. The flat portion is configured to prevent the top leg portion from moving away from the bottom leg portion under the spring force. The tapered portion is configured to provide regulation to movements of the top leg portion away from the bottom leg portion under the spring force.

In some embodiments, the top portion can be coupled to the bottom portion in discrete and continuous steps. For example, the multi-point locking system can be configured to change a first separation between the top leg portions and the bottom leg portions in discrete steps. The top leg portions can be coupled to the top beam through a moving mechanism configured to continuously change a second separation between the top beam and the top leg portions. For example, the top leg portion can be coupled to the top beam through a rotational to linear coupling, such as a turnbuckle, configured to continuously change a second separation between the top beam and the top leg portions.

In some embodiments, the workstand can be configured to be foldable into one bundle. Alternatively, the workstand can be configured to be foldable into two separate bundles, e.g., the top portion can be folded into one bundle and the bottom portion can be folded into another bundle.

In some embodiments, each top leg portion can be coupled to the top beam through a hinge, which can allow the top leg portion to be folded along the length of the top beam. The hinges for the two top leg portions can be staggered, e.g., having the pivot joints at different portions of the top leg portions, to allow the two top leg portions to be folded to form a bundle having three parallel beams of the top beam and the two top leg portions. For example, a first top leg portion can have a hinge at the end of the first top leg portion, which can allow the first top leg portion to be folded next to the top beam. A second top leg portion can have a hinge at a distance away from the end of the second top leg portion, which can allow the second top leg portion to be folded next to the first top leg portion.

In some embodiments, the top beam can also have a hinge, such as at a middle portion of the top beam, which can allow the top beam to be folded in half. Together with the folding of the top leg portions, the folding of the top beam can fold the top portion in half, along a middle direction.

In some embodiments, the multi-point locking system can include a hinge, which can be configured to allow the multi-point locking system to be folded. Thus, the top beam, the top leg portions, and the multi-point locking system can be folded into one bundle. The bundle can also included stand legs folded along the bottom leg portions, such as through another set of hinges.

In some embodiments, the top portion including the top beam and the top leg portions can be folded into a first bundle. The bottom portion, including the bottom leg portions and the multi-point locking system can be folded into a second bundle. The second bundle can also included stand legs folded along the bottom leg portions, such as through another set of hinges.

What is claimed is:

1. A workstand comprising a top portion, wherein the top portion comprises a top beam coupled to a first and a second top leg portions, a bottom portion, wherein the bottom portion comprises a first and a second bottom leg portions, wherein the first top leg portion is configured to be slidably coupled to the first bottom leg portion, wherein the second top leg portion is configured to be slidably coupled to the second bottom leg portion, a multi-point locking system, wherein the multi-point locking system is coupled to the bottom portion, wherein the multi-point locking system is configured to simultaneously secure the first top leg portion to the first bottom leg portion and the second top leg portion to the second bottom leg portion, wherein the multi-point locking system comprises a first and a second rod assemblies disposed in opposite directions, wherein the first rod assembly comprises a first latch element, wherein the second rod assembly comprises a second latch element, wherein the first rod assembly is configured to be toggled between an engaged state and a disengaged state of the first top leg portion with the first bottom leg portions, wherein the second rod assembly is configured to be toggled between the engaged state and the disengaged state of the second top leg portion with the second bottom leg portions, wherein in the engaged state, the first latch element is configured to mate to a first recess in the first top leg portion to prevent the first top leg portion from sliding relative to the first bottom leg portion, wherein in the engaged state, the second latch element is configured to mate to a second recess in the second top leg portion to prevent the second top leg portion from sliding relative to the second bottom leg portion, wherein in the disengaged state, the first latch element is configured to be released from the first recess to allow the first top leg portion to slide relative to the first bottom leg portion, wherein in the disengaged state, the second latch element is configured to be released from the second recess to allow the second top leg portion to slide relative to the second bottom leg portion, wherein the multi-point locking system comprises at least one of a first snap mechanism for securing the first and second rod assemblies to the engaged state, or a second snap mechanism for securing the first and second rod assemblies to the disengaged state.

2. A workstand as in claim 1, wherein the multi-point locking system comprises a handle coupled to the first and second rod assemblies, wherein the handle, when turning, is configured to toggle the first and second latch elements between the engaged state and the disengaged state.

3. A workstand as in claim 1, wherein the first rod assembly comprises the first latch element coupled to a first spring, wherein the second rod assembly comprises the second latch element coupled to a second spring, wherein the first and second springs are configured to bias the first and second latch elements into the engaged state.

4. A workstand as in claim 1, wherein the first and second rod assemblies are coupled to a rotatable handle, wherein the handle is configured to toggle the first and second rod assemblies between the engaged state or the disengaged state, wherein in the engaged state, the first and second rod assemblies form a straight line to prevent from accidental being released from the engaged state.

5. A workstand as in claim 1,
wherein the first and second latch elements are coupled to a control element for engaging or disengaging the first and second latch elements.

6. A workstand as in claim 1, further comprising
a spring configured to push the first or second top leg portion away from the first or second bottom leg portion, respectively.

7. A workstand as in claim 1, further comprising
a spring configured to exert a force to the first or second top leg portion away from the first or second bottom leg portion, respectively,
wherein the first and second latch elements are coupled to a handle for regulating the force.

8. A workstand as in claim 1, further comprising
a spring configured to exert a force to the first or second top leg portion away from the first or second bottom leg portion, respectively,
wherein first recess comprises a flat portion and a tapered portion,
wherein the flat portion is configured to prevent the first top leg portion from moving away from the first bottom leg portion under the spring force,
wherein the tapered portion is configured to provide regulation to movements of the first top leg portion away from the first bottom leg portion under the spring force.

9. A workstand as in claim 1,
wherein the top leg portions are coupled to the top beam through a turnbuckle mechanism,
wherein the turnbuckle mechanism is configured to continuously change a separation between the top beam and the top leg portions.

10. A workstand as in claim 1,
wherein the multi-point locking system is configured to change a first separation between the top leg portions and the bottom leg portions in discrete steps,
wherein the top leg portions are coupled to the top beam through a moving mechanism configured to continuously change a second separation between the top beam and the top leg portions.

11. A workstand as in claim 1,
wherein the multi-point locking system is configured to change a first separation between the top leg portions and the bottom leg portions in discrete steps,
wherein the top leg portions are coupled to the top beam through a rotational to linear coupling configured to continuously change a second separation between the top beam and the top leg portions.

12. A workstand as in claim 1,
wherein the workstand is configured to be foldable into one or two bundles.

13. A workstand as in claim 1,
wherein the two top leg portions are coupled to the top beam through first hinges,
wherein the first hinges are configured to allow the top leg portions to be folded along a length of the top beam,
wherein the top beam comprises a second hinge,
wherein the second hinge is configured to allow the top beam to be folded,
wherein the multi-point locking system comprises a third hinge,
wherein the third hinge is configured to allow the multi-point locking system to be folded,
wherein the first hinges, the second hinge, and the third hinge are configured to fold the workstand into one bungle.

14. A workstand as in claim 1, wherein the two top leg portions are coupled to the top beam through first hinges,
wherein the first hinges are configured to allow the top leg portions to be folded along a length of the top beam,
wherein the top beam comprises a second hinge,
wherein the second hinge is configured to allow the top beam to be folded,
wherein the multi-point locking system comprises a third hinge,
wherein the third hinge is configured to allow the multi-point locking system to be folded,
wherein the bottom leg portions comprise stand legs coupled to the bottom leg portions through fourth hinges,
wherein the fourth hinges are configured to allow the stand legs to be folded along a length of the bottom leg portions,
wherein the first hinges, the second hinge, the third hinge, and the fourth hinges are configured to fold the workstand into one bungle.

15. A workstand as in claim 1,
wherein the two top leg portions are coupled to the top beam through first hinges,
wherein the first hinges are configured to allow the top leg portions to be folded along a length of the top beam to form a first bundle,
wherein the multi-point locking system comprises a second hinge,
wherein the second hinge is configured to allow the multi-point locking system to be folded along a length of the bottom leg portions to form a second bungle.

16. A workstand as in claim 1,
wherein the two top leg portions are coupled to the top beam through first hinges,
wherein the first hinges are configured to allow the top leg portions to be folded along a length of the top beam to form a first bundle,
wherein the multi-point locking system comprises a second hinge,
wherein the bottom leg portions comprise stand legs coupled to the bottom leg portions through third hinges,
wherein the third hinges are configured to allow the stand legs to be folded along the length of the bottom leg portions,
wherein the second hinge and the third hinges are configured to fold the bottom portion a second bungle.

17. A workstand comprising
a top portion,
wherein the top portion comprises a top beam couples to two top leg portions,
a bottom portion,
wherein the bottom portion comprises two bottom leg portions,
wherein each top leg portion of the two top leg portions is configured to be slidably coupled to a bottom leg portion of the two bottom leg portions,
a multi-point locking system,
wherein the multi-point locking system is coupled to the bottom portion,
wherein the multi-point locking system is configured to simultaneously secure the two top leg portions to the two bottom leg portions,
wherein the multi-point locking system comprises two latch elements disposed in opposite directions,
wherein the two latch elements are coupled to a control handle through opposite rod assemblies for engaging or disengaging the two latches, wherein in the engaged state, the latches are configured to block sliding movements of the top leg portions relative to the bottom leg portion, wherein in the disengaged state, the latches are configured to regulate sliding movements of the top leg portions relative to the bottom leg portion, wherein the multi-point locking system comprises at least one of a first snap mechanism for securing the rod assemblies to the engaged state, or a second snap mechanism for securing the rod assemblies to the disengaged state, wherein the top portions and the bottom portion each comprises one or more hinges configured to fold the top portions and the bottom portion into one or two separate bundles.

18. A workstand as in claim 17, further comprising a spring configured to exert a force to the top leg portion away from the bottom leg portion, wherein each latch element is configured to mate with a recess of multiple recesses in a top leg portion, wherein the recess comprises a flat portion and a tapered portion, wherein the flat portion is configured to prevent the top leg portion from moving away from the bottom leg portion under the spring force, wherein the tapered portion is configured to provide the sliding movement regulation of the top leg portion relative to the bottom leg portion under the spring force.

19. A workstand comprising a top portion, wherein the top portion comprises a top beam coupled to two top leg portions, a bottom portion, wherein the bottom portion comprises two bottom leg portions, wherein each top leg portion of the two top leg portions is configured to be slidably coupled to a bottom leg portion of the two bottom leg portions, a multi-point locking system, wherein the multi-point locking system is coupled to the bottom portion, wherein the multi-point locking system is configured to simultaneously secure the two top leg portions to the two bottom leg portions, wherein the multi-point locking system is configured to change a first separation between the top leg portions and the bottom leg portions in discrete steps, wherein the top leg portions are coupled to the top beam through a turnbuckle mechanism configured to continuously change a second separation between the top beam and the top leg portions, wherein the multi-point locking system comprises two latch elements disposed in opposite directions, wherein the two latch elements are coupled to a control handle through opposite rod assemblies for engaging or disengaging the two latches, wherein in the engaged state, the latches are configured to block sliding movements of the top leg portions relative to the bottom leg portion, wherein in the disengaged state, the latches are configured to regulate sliding movements of the top leg portions relative to the bottom leg portion, wherein the multi-point locking system comprises at least one of a first snap mechanism for securing the rod assemblies to the engaged state, or a second snap mechanism for securing the rod assemblies to the disengaged state, wherein the top portions and the bottom portion each comprises one or more hinges configured to fold the top portions and the bottom portion into one or two separate bundles.

* * * * *